US009357293B2

(12) United States Patent
Claussen

(10) Patent No.: US 9,357,293 B2
(45) Date of Patent: May 31, 2016

(54) METHODS AND SYSTEMS FOR DOPPLER RECOGNITION AIDED METHOD (DREAM) FOR SOURCE LOCALIZATION AND SEPARATION

(75) Inventor: Heiko Claussen, Plainsboro, NJ (US)

(73) Assignee: Siemens Aktiengesellschaft, Munich (DE)

( * ) Notice: Subject to any disclaimer, the term of this patent is extended or adjusted under 35 U.S.C. 154(b) by 315 days.

(21) Appl. No.: 13/472,735

(22) Filed: May 16, 2012

(65) Prior Publication Data

US 2013/0308790 A1 Nov. 21, 2013

(51) Int. Cl.
*H04R 3/00* (2006.01)
*H04R 1/40* (2006.01)

(52) U.S. Cl.
CPC ..... *H04R 3/00* (2013.01); *H04R 1/406* (2013.01); *H04R 3/005* (2013.01); *H04R 2430/20* (2013.01); *H04R 2430/21* (2013.01)

(58) Field of Classification Search
USPC ..... 381/92, 122
See application file for complete search history.

(56) References Cited

U.S. PATENT DOCUMENTS

2005/0100172 A1* 5/2005 Schliep ..... G08G 1/015 381/71.4
2006/0092854 A1* 5/2006 Roder ..... H04S 7/30 370/252
2009/0129609 A1* 5/2009 Oh et al. ..... 381/92
2011/0110531 A1* 5/2011 Klefenz ..... H04R 3/005 381/92
2013/0123962 A1* 5/2013 Mizuta ..... 700/94

* cited by examiner

*Primary Examiner* — Duc Nguyen
*Assistant Examiner* — George Monikang

(57) ABSTRACT

Systems and methods are provided for source localization and separation by sampling a large scale microphone array asynchronously to simulate a smaller size but moving microphone array. Signals that arrive from different angles at the array are shifted differently in their frequency content. The sources are separated by evaluating correlated and even equal frequency content. Compressive sampling enables the utilization of extremely large scale microphone arrays by reducing the computational effort orders of magnitude in comparison to standard synchronous sampling approaches. Processor based systems to perform the source separation methods are also provided.

20 Claims, 12 Drawing Sheets

METHODS AND SYSTEMS FOR DOPPLER RECOGNITION AIDED METHOD (DREAM) FOR SOURCE LOCALIZATION AND SEPARATION

BACKGROUND OF THE INVENTION

The present invention relates generally to acoustic source separation and localization and more particularly to acoustic source separation with a microphone array wherein a moving microphone array is simulated.

Acoustic localization and analysis of multiple industrial sound sources such as motors, pumps etc., are challenging as their frequency content is largely time invariant and emissions of similar machines are highly correlated. Therefore, standard assumptions for localization, taken e.g. in DUET as described in "[I] J S. Rickard, R. Balan, and J. Rosca. Real-Time Time-Frequency Based Blind Source Separation. In Proc. of International Conference on Independent Component Analysis and Signal Separation (ICA2001), pages 651-656, 2001" such as disjoint time-frequency content of the sources, do not hold, and yield unsatisfactory results.

More powerful Bayesian DOA methods such as MUST as described in "[2] T. Wiese, H. Claussen, J. Rosca. Particle Filter Based DOA for Multiple Source Tracking (MUST). To be published in Proc. of ASILOMAR, 2011" assume knowledge of the number of sources. It is, however, difficult to estimate this for correlated sources in echoic environments. Source localization is very difficult if sources are possibly in the near field of the microphones. It is challenging to test and account for the presence of these sources.

One possible approach is to increase the number of synchronously sampled microphones in an array. However, this results in extremely high data-rates and is too computationally expensive Accordingly, improved and novel methods and systems for computationally tractable source separation and localization are required.

SUMMARY OF THE INVENTION

Aspects of the present invention provide systems and methods to perform direction of arrival determination of a plurality of acoustical sources transmitting concurrently by applying one or more virtually moving microphones in a microphone array, which may be a linear array of microphones.

In accordance with an aspect of the present invention a method is provided to separate a plurality of concurrently transmitting acoustical sources, comprising receiving acoustical signals transmitted by the concurrently transmitting acoustical sources by a linear microphone array with a plurality of microphones, sampling by a processor at a first moment, signals generated by a first number of microphones in a first position in the linear microphone array, sampling by the processor at a second moment, signals generated by the first number of microphones in a second position in the linear microphone array, wherein a first sampling frequency is based on a first virtual speed of the first number of microphones moving from the first position to the second position in the linear microphone array and the processor determining a Doppler shift from the sampled signals based on the first virtual speed of the first number of microphones.

In accordance with a further aspect of the present invention a method is provided, wherein a direction of a source in the plurality of concurrently transmitting acoustical sources relative to the linear microphone array is derived from the Doppler shift.

In accordance with yet a further aspect of the present invention a method is provided, wherein the linear microphone array has at least 100 microphones.

In accordance with yet a further aspect of the present invention a method is provided, wherein the first number of microphones is one.

In accordance with yet a further aspect of the present invention a method is provided, wherein the first number of microphones is at least two.

In accordance with yet a further aspect of the present invention a method is provided, wherein the first virtual speed is at least 1 m/s.

In accordance with yet a further aspect of the present invention a method is provided, further comprising the processor determining the plurality of acoustical sources.

In accordance with yet a further aspect of the present invention a method is provided, wherein at least one source is a near field source.

In accordance with yet a further aspect of the present invention a method is provided, wherein at least two sources generate signals that have a correlation that is greater than 0.8.

In accordance with yet a further aspect of the present invention a method is provided, further comprising the first number of microphones in the linear microphone array is operated at a second virtual speed.

In accordance with yet a further aspect of the present invention a method is provided, further comprising sampling a second number of microphones in the linear array of microphones at a second and a third virtual speed to determine the first virtual speed.

In accordance with another aspect of the present invention a system to separate a plurality of concurrently transmitting acoustical sources, comprising memory enabled to store data, a processor enabled to execute instructions to perform the steps: sampling at a first moment, signals generated by a first number of microphones in a first position in a linear microphone array with a plurality of microphones, sampling at a second moment, signals generated by the first number of microphones in a second position in the linear microphone array, wherein a first sampling frequency is based on a first virtual speed of the first number of microphones moving from the first position to the second position in the linear microphone array and determining a Doppler shift from the sampled signals based on the first virtual speed of the first number of microphones.

In accordance with yet another aspect of the present invention a system is provided, wherein a direction of a source in the plurality of concurrently transmitting acoustical sources relative to the linear microphone array is derived from the Doppler shift.

In accordance with yet another aspect of the present invention a system is provided, wherein the linear microphone array has at least 100 microphones.

In accordance with yet another aspect of the present invention a system is provided, wherein the first number of microphones is one.

In accordance with yet another aspect of the present invention a system is provided, wherein the first number of microphones is at least two.

In accordance with yet another aspect of the present invention a system is provided, wherein at least one source is a near field source.

In accordance with yet another aspect of the present invention a system is provided, wherein at least two sources generate signals that have a correlation that is greater than 0.8.

In accordance with yet another aspect of the present invention a system is provided, further comprising the first number of microphones in the linear microphone array being sampled at a sampling frequency corresponding with a second virtual speed.

In accordance with yet another aspect of the present invention a system is provided, further comprising the processor sampling a second number of microphones in the linear array of microphones at a second and a third virtual speed to determine the first virtual speed.

DETAILED DESCRIPTION

Methods for Doppler recognition aided methods for acoustical source localization and separation and related processor based systems as provided herein in accordance with one or more aspects of the present invention will be identified herein as DREAM or the DREAM or DREAM methods or DREAM systems.

Figure 1:
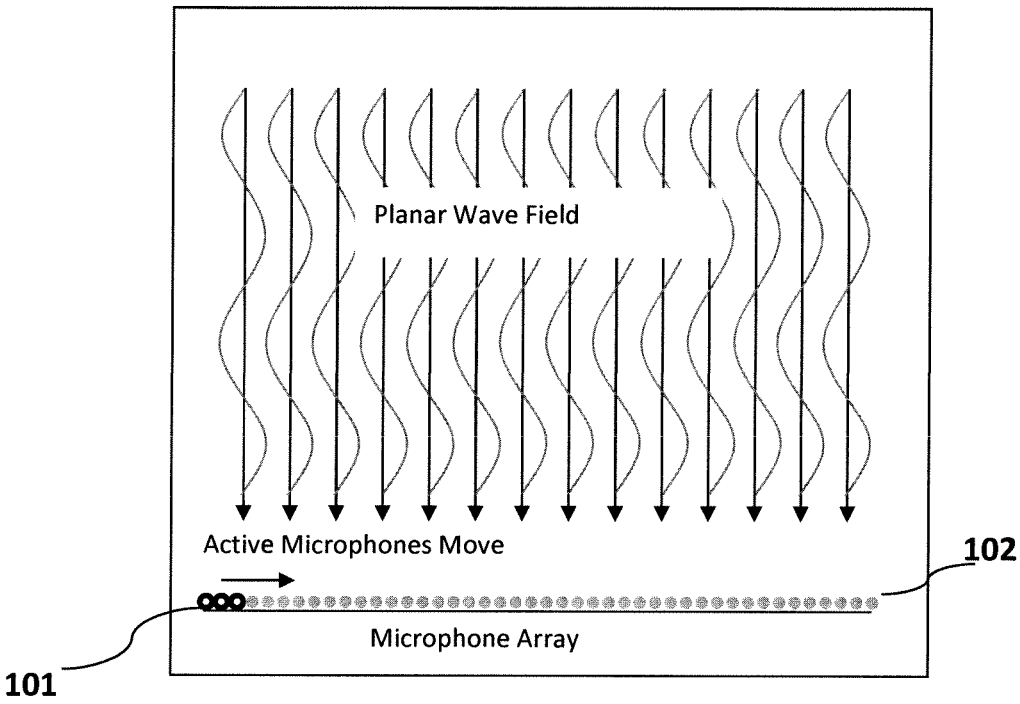
FIGS. 1 and 2 illustrate wavefields detected with a microphone array in accordance with one or more aspects of the present invention.
Figure 2:
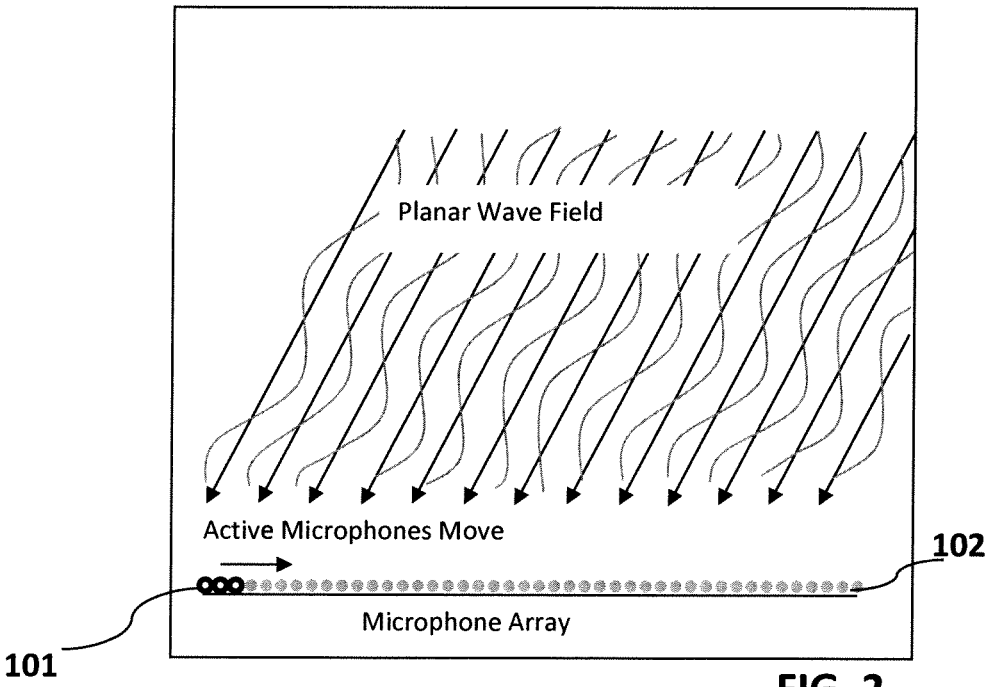

The DREAM methods and systems for source localization and separation simulate a moving microphone array by sampling different microphones of a large microphone array at consecutive sampling times. An assumption is that sources far away from the array generate planar wave fields. FIGS. 1 and 2 illustrate the concept of a virtually moving microphone array for planar wave fields from sources at different locations.

The DREAM concept illustrated. FIG. 1 shows that a planar wave field arrives from a source orthogonal to the array. The frequencies recorded by the virtually moving microphone array 101 represent the frequencies of the arriving wave. FIG. 2 shows planar wave field arrives from a source at an angle with the array. The frequencies recorded by the virtually moving microphone array are Doppler shifted to higher frequencies.

The complete array of microphones is identified as 102. The active or sampled microphones which form the moving array are identified as 101. The frequency content of the recorded data shifts dependent on the direction of arrival of the planar wave field and the speed of the virtually moving array according to the Doppler Effect.

The frequency content of multiple simultaneously active sources mixes. The phase of a frequency component of a wave that arrives at a microphone is likely to be altered if multiple sources have energy at this frequency bin.

In accordance with one aspect of the present invention, the frequency contributions from different sources are separated by shifting them dependent on the locations of their sources. Thereafter, they can be localized using standard methods on the separated frequency components jointly with the information about the amount that the frequencies were shifted given a specific speed of the virtually moving microphone array. There will be no shift for far field sources orthogonal to the microphone array and a maximal shift for sources that are in the direction of the microphone array.

Besides localization and separation of the frequency content, in accordance with another aspect of the present invention, the number of sources can be detected. Also, the frequency contributions of each source can be estimated. The contributions from each source location move jointly according to the Doppler Effect.

Near field sources can be distinguished from far field sources as the shift of their frequency content changes dependent on the location of the virtually moving source. That is, a near field source looks to the Doppler Effect aided source localization as if it is moving. This information about the bend wave field of a near field source can be used to estimate the distance of the source from the microphone array.

For a near field source, the direction of the source appears different for each microphone location in the array. By using the different microphone locations and the respective directions to the source one can triangulate the source location distance to the array (See FIG. 3. One can draw the lines from different microphone locations. The point where the lines intersect is the location of the source). For example, if the first microphones of the array point to an angle of 45 degrees and the last microphones to an angle of 135 degrees, then (given that the source is a point source) the source location is in the center of the array and at a distance of half the array length.

As stated above, acoustic localization and analysis of multiple industrial sound sources are challenging as their frequency content is largely time invariant and emissions of similar machines are highly correlated. Therefore, standard assumptions for localization, such as disjoint time-frequency content of the sources do not hold. More powerful Bayesian DOA methods assume knowledge of the number of sources. It is difficult to estimate this for correlated sources in echoic environments. Source localization is very difficult if sources are possibly in the near field of the microphones. It is challenging to test and account for the presence of these sources.

It is believed that no work currently exists that uses a virtually moving microphone to utilize the Doppler Effect in order to separate or localize correlated acoustic sources. The concept of virtual movement of antennas is not new for radio direction finding as described for instance in "[12] D. Peavey and T. Ogunfunmi. The Single Channel Interferometer Using A Pseudo-Doppler Direction Finding System IEEE Transactions on Acoustics, Speech, and Signal Processing, 45(5): 4129-4132, 1997," "[13] R. Whitlock. High Gain Pseudo-Doppler Antenna. Loughborough Antennas & Propagation Conference. 2010" and "[14] D. C. Cunningham, "Radio Direction Finding System", U.S. Pat. No. 4,551,727, Nov. 5, 1985." In these references, an antenna array of generally 4 circularly arranged antennas is virtually rotated by selecting one antenna at a time in a circular pattern. This results in a sinusoidal shift of the carrier tone with phase dependency on the location of the emitter and the sampling pattern of the antennas. The low number of antennas works for the radio direction finding because of the constant carrier frequency. Such a low number will not work or suffice in acoustical problems for source separation. In general a linear array of microphones as applied for DREAM should have at least 90 and preferably at least 100 microphones.

A disadvantage of this method was found to be its phase sensitivity which limits its use for modulated data as described in "[13] R. Whitlock. High Gain Pseudo-Doppler Antenna. Loughborough Antennas & Propagation Conference. 2010." The herein provided DREAM methods and systems do not utilize an array of circular rotating microphones but e.g., a large linear array and thus results in a constant, angle dependent frequency shift of the signal which does not result in this phase sensitivity problem. Also, in contrast to electro-magnetic communication signals, industrial acoustic sources are generally not artificially modulated and have no constant carrier signal.

DREAM, in accordance with various aspects of the present invention, is applied to virtually moving microphones, which require large arrays of e.g., 100 or more linearly arranged microphones, as actually moving microphones would create problems due to distortions from airflow and accelerating forces. Large microphone arrays of 512 and 1020 microphones have only been recently reported (see "[3] H. F. Silverman, W. R. Patterson, and J. L. Flanagan. The huge microphone array. Technical report, LEMS, Brown University, May 1996" and "[4] E. Weinstein, K. Steele, A. Agarwal, and J. Glass, LOUD: A 1020-Node Microphone Array and Acoustic Beamformer. International Congress on Sound and Vibration (ICSV), July 2007, Cairns, Australia" for instance). Reference "[4] E. Weinstein, K. Steele, A. Agarwal, and J. Glass, LOUD: A 1020-Node Microphone Array and Acoustic Beamformer. International Congress on Sound and Vibration (ICSV), July 2007, Cairns, Australia" holds an entry in the Guinness book of world records for the largest microphone array in the world.

Generally, arrays with a large number of microphones are using the microphones in a 2D or 3D arrangement as for example acoustic cameras as described online website "[5] URLwww.acousic-camera.com/en/acoustic-camera-en."

The largest microphone array described in "[4] E. Weinstein. K. Steele, A. Agarwal, and J. Glass, LOUD: A 1020-Node Microphone Array and Acoustic Beamformer. International Congress on Sound and Vibration (ICSV), July 2007, Cairns, Australia" has 17×60 microphones in a 2D arrangement. As the virtual microphone array is moved at every sample in one direction, even this microphone array would limit the moves to maximally 60 before the location has to be reset. Based on these 60 instances, the angle of arrival dependent frequency shift has to be analyzed. Clearly, this is at the limit where Doppler Effect aided source localization works for a linear array. Therefore, it is believed to be highly unlikely that this approach has been taken before.

Other work that utilizes the Doppler Effect for sensing is e.g., the redshift in astrophysics or the Doppler radar for velocity monitoring of vehicles or airplanes as described online in "[6] URLwww.fas.org/man/dod-101/nay/docs/es310/cwradar.htm." However, these sensing approaches aim generally at velocity detection and do not use the Doppler Effect to disambiguate sources passively based on their emissions from a fixed location.

Algorithms that aim on direction of arrival (DOA) estimation are widespread in the literature. Approaches include ESPRIT as described in "[7] R. Roy and T. Kailath. Esprit-estimation of signal parameters via rotational invariance techniques. Acoustics, Speech and Signal Processing, IEEE Transactions on, 37(7):984, July 1989" and MUSIC as described in "[8] R. Schmidt. Multiple Emitter Location and Signal Parameter Estimation. Antennas and Propagation, IEEE Transactions on, 34(3):276, March 1986" for narrow band and CSSM as described in "[9] D. N. Swingler and J. Krolik. Source Location Bias in the Coherently Focused High-Resolution Broad-Band Beamformer. Acoustics, Speech and Signal Processing, IEEE Transactions on, 37(1): 143-145, January 1989" for wideband source assumptions. All these methods take advantage of the spatial distribution of the microphones in the array that results in source location dependent phase shifts between the signals.

In case of high interference, these methods are extended by blind source separation approaches such as described in DUET "[1] J S. Rickard, R. Balan, and J. Rosca. Real-Time Time-Frequency Based Blind Source Separation. In Proc. of International Conference on Independent Component Analysis and Signal Separation (ICA2001), pages 651-656, 2001" or DESPRIT "[10] T. Melia and S. Rickard. Underdetermined Blind Source Separation in Echoic Environments Using DESPRIT. EURASIP Journal on Advances in Signal Processing, 2007" which are both incorporated herein by reference.

Disadvantages of Prior Systems

Narrow-band direction of arrival methods suffer if source signals are highly correlated. This limits their usability for many industrial applications or echoic environments. The alternative to use wideband DOA often relies on an estimation of the number of active sources. This estimation is difficult for correlated sources and echoic environments. To model all reflections as separate sources is generally not possible due to their possibly vast but unknown number and the resulting complexity. Note that even simple wideband DOA approaches were long considered intractable as described in "[11] J. A. Cadzow. Multiple Source Localization—The Signal Subspace Approach. IEEE Transactions on Acoustics, Speech, and Signal Processing, 38(7): 1110-1125, July 1990." Therefore, the ability of this approach to fully model the environment is limited.

One possibility to push the limit in source localization and separation is to increase the number of microphones in an array. The performance of the array is linearly improving with the number of microphones. However, synchronous sampling of these large arrays, and possibly orders of magnitude larger arrays in the future, results in very large data rates. E.g. the microphone array described in "[4] E. Weinstein, K. Steele, A. Agarwal, and J. Glass, LOUD: A 1020-Node Microphone Array and Acoustic Beamformer. International Congress on Sound and Vibration (ICSV), July 2007, Cairns, Australia"

generates nearly 50 MB/s of audio data. These large amounts of data either limit the use of the algorithms or require compressive sampling approaches to make them computationally tractable.

A main cost driver of modern large scale microphone arrays is the requirement for separate data acquisition hardware per channel to enable synchronous recordings. Also, the synchronously sampled data is only limited usable for the proposed Doppler Effect aided source localization and separation. The reason is that only few, discrete speeds of the virtually moving microphone array are realizable with this data.

Methods generally disregard possible near field scenarios for correlated sources and in echoic, noisy environments due to the already very complex issue of source localization. Those cases are only addressed in a limited number of applications such as the acoustic cameras.

Advantages of the DREAM Methods and Systems

An advantage of the DREAM over former approaches is that it opens an additional physically disjoint dimension for source separation and localization. That is, while all previous array processing methods still apply, it is possible to use the additional information on the frequency shift of each signal for a refinement of source localization and separation.

Given a fixed source direction and frequency bin it is possible with the DREAM to shift this bin to another frequency such that it interferes minimally with other sources. That is, first, the spectrum can be monitored with a microphone at a fixed location to find areas with low noise. Second, the speed of the virtually moving microphone can be adjusted to move the frequency bin of interest into this region with low distortion.

Furthermore, the DREAM enables that the same signal is simultaneously monitored with different speeds of virtually moving microphones (by moving and recording multiple virtual microphone arrays at the same time).

As an illustrative example a linear array of 1000 microphones is assumed with microphone distances of 1 cm and an overall array length of 10 m. There exist two far field sources with an angle alpha of 45 and 180 degrees. The first source is of high intensity and wide band with a notch at 500 Hz (where no signal is emitted). The second source has a frequency content at 1 kHz and at 2 kHz. A virtual speed of the microphones does not affect the position of the notch at 500 Hz due to the angle of 45 degrees of the first source. However, the frequency components of the other source are shifted by (1+v/c)f. By selecting the virtual speed of the microphones v such that (1+v/c) equals 0.5 and 0.25, the frequency component of source two (at 1 and 2 kHz) are shifted into the notch at 500 Hz of the first source. Therefore, they can be recorded without distortion. The virtual speed v that achieves this is −0.5 c and −0.75 c (171.5 m/s and 257.25 m/s respectively for air). That is, the microphones have to be sampled in sequence at 17150 Hz and 25725 Hz respectively (given the microphone distance of 1 cm).

Thus, the frequency content of all sources is constant between the recordings but they are differently shifted in the frequency domain dependent on their location. In this way, knowing the transformation of the Doppler Effect, the separate signals can be estimated, separated and localized without requiring an assumption of an invariant source signal.

Figure 3:
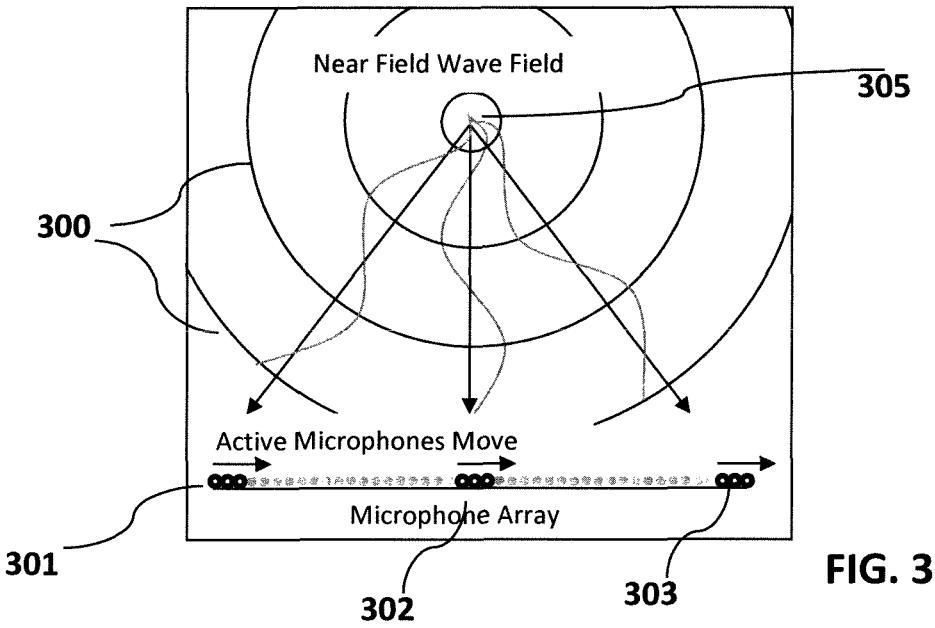
FIG. 3 illustrates a microphone array which applies one or more virtually moving microphones in accordance with one or more aspects of the present invention.
Figure 4:
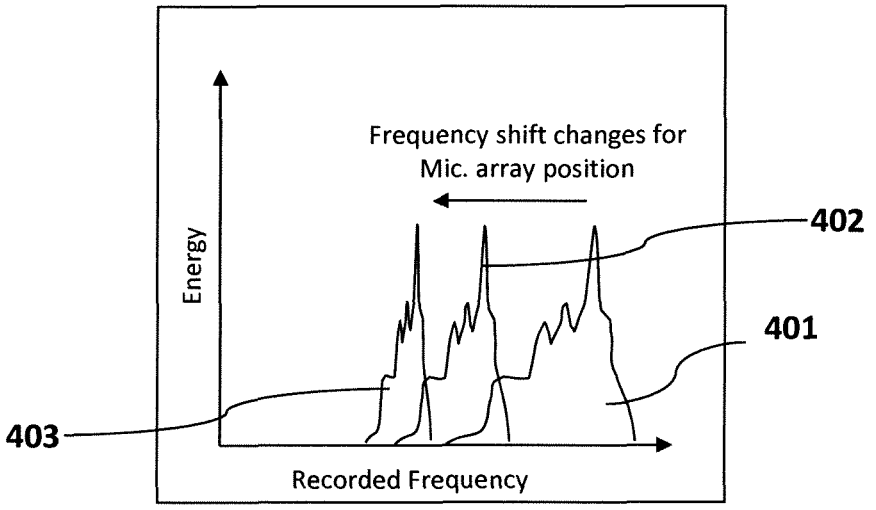
FIG. 4 illustrates frequency shifts based on one or more virtually moving microphones in accordance with one or more aspects of the present invention.

FIGS. 3 and 4 illustrate the effect of a near field source on the DREAM. FIG. 3 illustrates how the wave field 300 propagates circular from a near field source 305. The angle of the arriving wave is different for various microphone positions on the array. Different sampled microphones 301, 302 and 303 simulating a moving microphone or sets of microphones. FIG. 4 illustrates the frequency shift of the recorded signal changes with the position of the virtually moving microphone array, wherein plots 401, 402 and 403 correspond to microphones, 301, 302 and 303, respectively. Shifts result either from a near field, moving or quickly changing source.

In contrast to far field sources, the virtually moving microphone results in a changing frequency shift. A similar effect is expected for moving sources. However, note that a moving source and moving receiver have different effects on the observed Doppler shift. This difference is discussed in more detail below. Near field and moving sources can be distinguished from far field sources at fixed positions.

Another advantage of DREAM is that it can utilize the power of large microphone arrays without requiring costly hardware for synchronous sampling or computationally intractable exhaustive evaluation of all signals.

Details

The principle of the Doppler Effect is successfully used in many applications including radar, ultrasound, astronomy, contact free vibration measurement etc. However, most of these applications actively emit a signal and evaluate the movement of another object. In contrast, the DREAM concept assumes a source that emits a signal from a constant location. The localization and separation of this sound is enabled by virtually moving the receiver.

Figure 5:
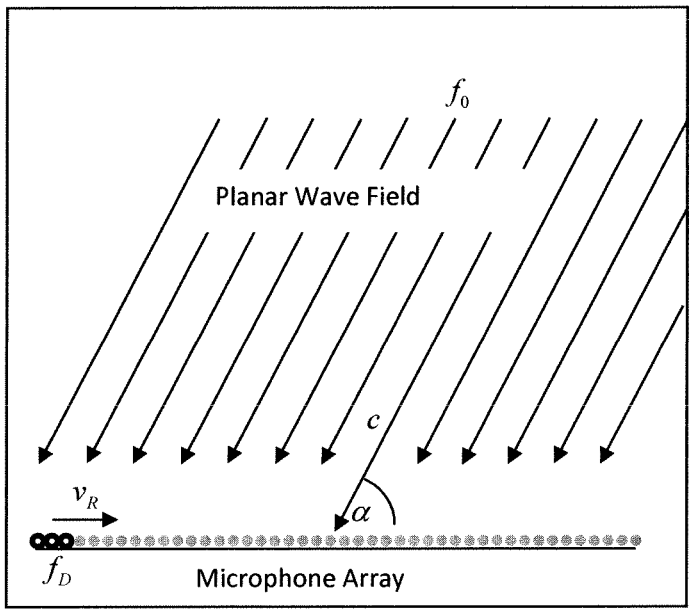
FIG. 5 illustrates a microphone array which applies one or more virtually moving microphones in accordance with one or more aspects of the present invention.

Let c, $f_0$ and $f_D$ represent the velocity of the wave in the medium, the emitted frequency and the Doppler shifted frequency, respectively. Furthermore, let $v_S$ and $v_R$ represent the velocity of the source and the receiver relative to the medium. The velocities are positive if the source/receiver approaches the position of the respective other. FIG. 5 illustrates a schematic concretization of the different parameters. The non relativistic Doppler shift, used for wave propagation in a medium such as sound in air, is given by:

$$f_D = \left(\frac{c + v_R}{c - v_S}\right) f_0$$

If, for simplicity, the source is not moving ($v_S$=0), the formula can be simplified to:

$$f_D = \left(1 + \frac{v_R}{c}\right) f_0$$

By considering the angle of the planar wave field, the formula is modified to:

$$f_D = \left(1 + \frac{v_R \cos\alpha}{c}\right) f_0$$

This shift is a factor to the originally emitted frequency. However, the shift in frequencies is not the same for moving sources and moving receivers even if they move with the same speed and the respective other remains at a constant location. For example, if the receiver directly approaches a fixed source location ($\alpha$=0°) with $v_R$=(¾)c, the recorded Doppler shifted frequency is $f_D$=1.75 $f_0$.

Figure 6:
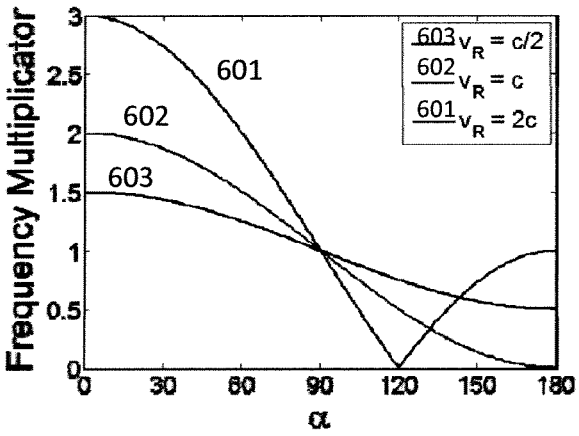
FIG. 6 illustrates frequency multiplication as a result of one or more virtually moving microphones in accordance with one or more aspects of the present invention.
Figure 7:
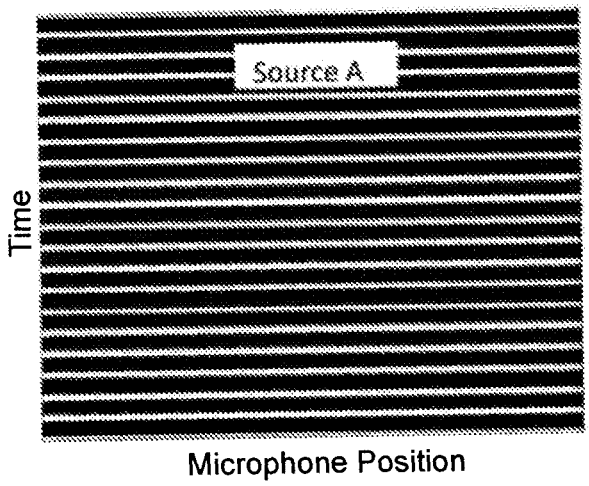
FIGS. 7-10 illustrate wavefields related to different sources of which a frequency shift based on one or more virtually moving microphones in accordance with one or more aspects of the present invention is to be determined.
Figure 8:
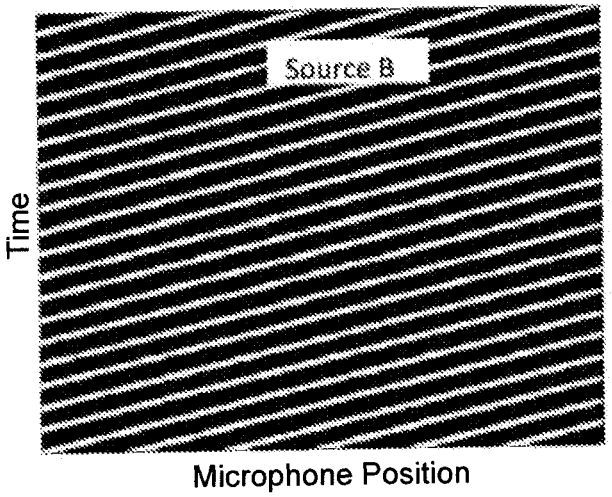
Figure 9:
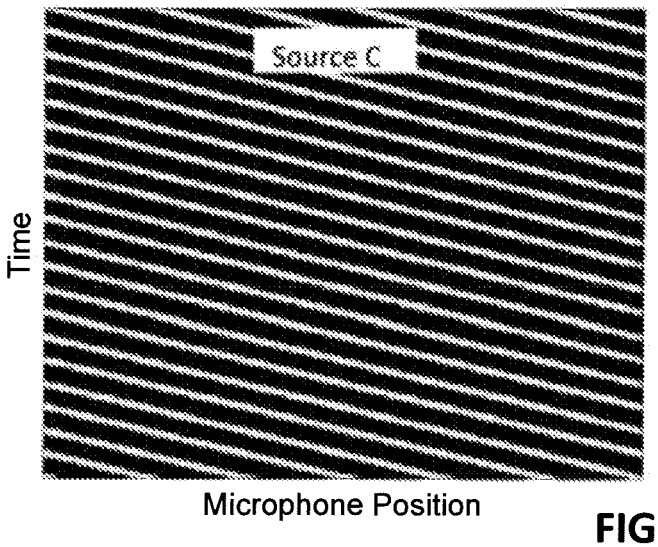
Figure 10:
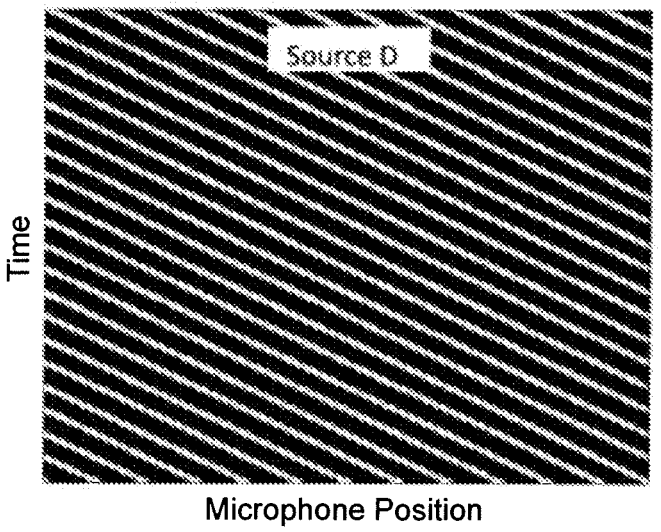

On the other hand, if the source directly approaches a fixed receiver location with $v_S$=(¾)c, the recorded Doppler shifted frequency is $f_D$=4 $f_0$. For virtually moving receivers and a source at a fixed location, the frequency shift is linearly with the speed of the receivers. Another important effect occurs for $v_R>c$. Assume that the source location is at ($\alpha=180°$). In this case, the observed frequency is increasing for $v_R>c$ linearly with c but with negative phase (as the microphones overtake the wave). This effect of angle and microphone dependent frequency shift is illustrated in FIG. 6. It shows 3 curves: curve 601 for $v_R=2$ c; curve 602 for $v_R=c$; and curve 603 for $v_R=c/2$.

The above demonstrates that the amount of virtual Doppler shift depends on the virtual speed of the receiver. To detect a Doppler shift in frequency with a reasonable accuracy and with reasonable efforts requires a minimum virtual speed of the microphones. In one embodiment of the present invention the virtual speed of the microphones is preferably at least 1 m/s. In one embodiment of the present invention the virtual speed of the microphones is more preferably at least 10 m/s. In one embodiment of the present invention the virtual speed of the microphones is even more preferably at least 100 m/s.

Figure 11:
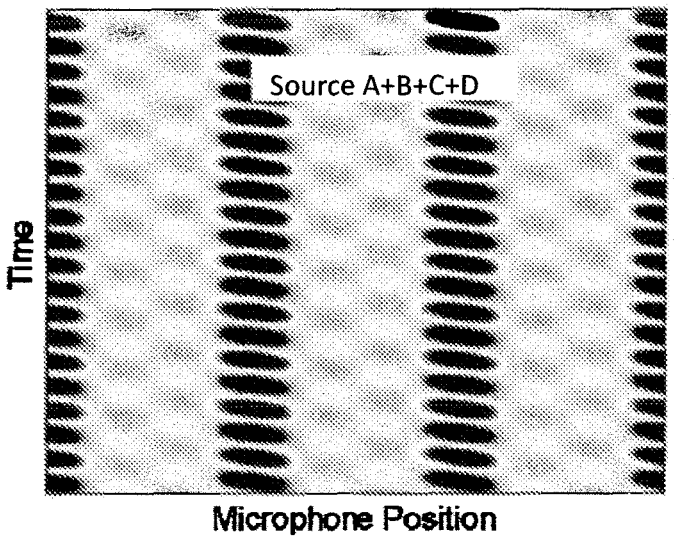
FIG. 11 illustrates a combined wavefield created from different sources of which a frequency shift based on one or more virtually moving microphones in accordance with one or more aspects of the present invention is to be determined.

In the following, the DREAM is illustrated on a simulated source separation and localization example. FIGS. 7-10 illustrate the wave fields of 4 far field sources A, B, C and D that emit a signal with the same frequency and amplitude from different directions from different source locations. FIG. 11 illustrates the wave field that results when all four sources A, B, C and D are simultaneously active. The aim is to estimate the number of sources, their locations, frequencies and amplitudes given only the mixed wave field in FIG. 11. This problem can be approached by synchronously sampling all microphones, assuming a number of sources and finding the delays of each source that explains the data best. This approach is generally computationally intensive. Alternatively, it is possible to use one or multiple virtually moving microphone arrays to disambiguate the source contributions.

Figure 12:
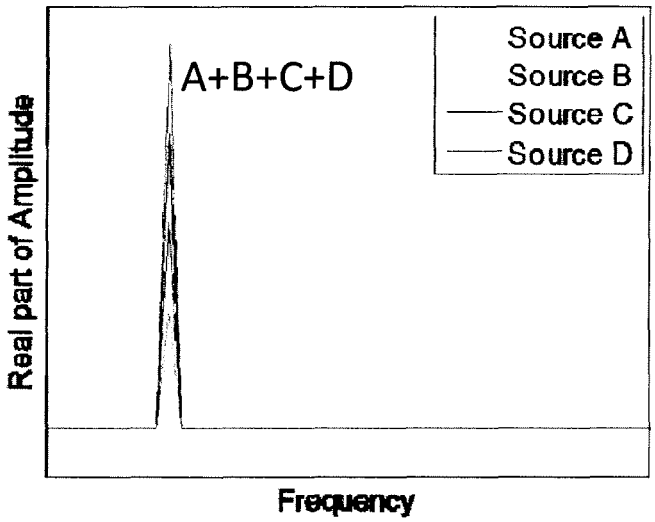
FIG. 12 illustrates frequency components of a combined wavefield from different sources.
Figure 13:
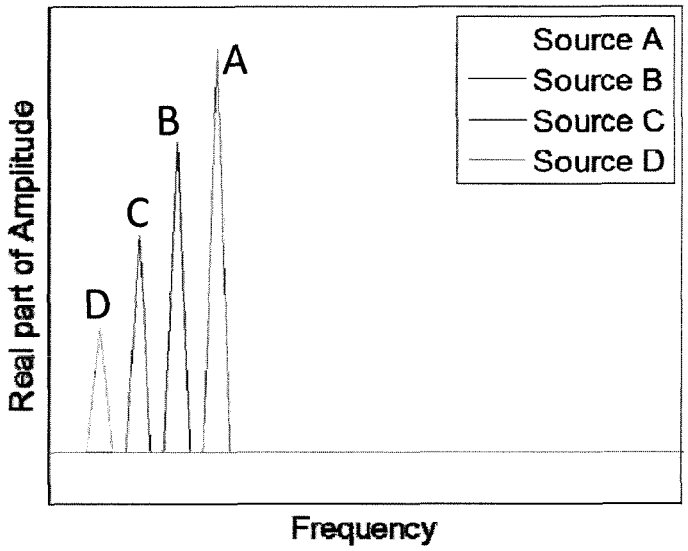
FIG. 13 illustrates separation of frequency components in a combined wavefield by applying one or more virtually moving microphones in accordance with one or more aspects of the present invention.

The results of both approaches are illustrated in FIGS. 12 and 13 for a single microphone. In this simple example, the DREAM allows a clear answer to the number or sources, their frequency content, amplitudes and locations. On the other hand, the phase contributions of all sources add for the not moving microphone. Thus, more complex methods must be taken to estimate the large number of parameters (number of sources, each of their frequency and amplitude contributions as well as their locations). In the current simple example, one needs to estimate 13 variables from the data that naturally appear using the DREAM. The 13 variables for the example related to FIG. 12 are: 4 source locations, 4 frequency contributions, 4 amplitude of frequency contribution, and 1 number of sources.

FIG. 12 illustrates a frequency representation of the first microphone when all sources are active. All sources are observed at the same frequency bin. Standard source localization utilizes the phase difference of each microphone to uncover the contribution of each source. FIG. 13 illustrates a frequency representation of a virtually moving microphone. The different source signals clearly separate. The frequency shift indicates the location of each source. Phase differences between microphones can be used to refine the source location estimate.

There are a couple of differences to be noted between the standard microphone array approaches and the herein provided DREAM approach. First there is a clear trade-off between the number of microphones, the microphone distance and the computational effort and costs using standard synchronously sampling based array processing. For example, there is only a limited gain for standard approaches if the microphone distances are small as noise is no longer uncorrelated.

In contrast, the DREAM gains from a large number of microphones with limited penalty from costs and computational effort. Reasons are that only a small subset of the microphones has to be sampled at each time instance and that not all microphones need parallel acquisition hardware such as analog to digital converters. The advantage of a large number of microphones is that DREAM can achieve a better resolution to detect the frequency shift of signals from different locations. Note that the frequency analysis in FIG. 13 is performed over a vector of a length that is equal to the number of microphones in the array.

Second, while synchronous sampling is necessary for standard approaches, it would limit the DREAM approach. For example, one could envision to sample synchronously and then to use DREAM on parts of this data. In such a case, a large bandwidth is required for the recording and no costs can be saved by a simplified hardware. Also, for synchronous sampling, the virtual speed of the microphone is limited to a multiple of the duration between samples times the microphone distance.

Figure 14:
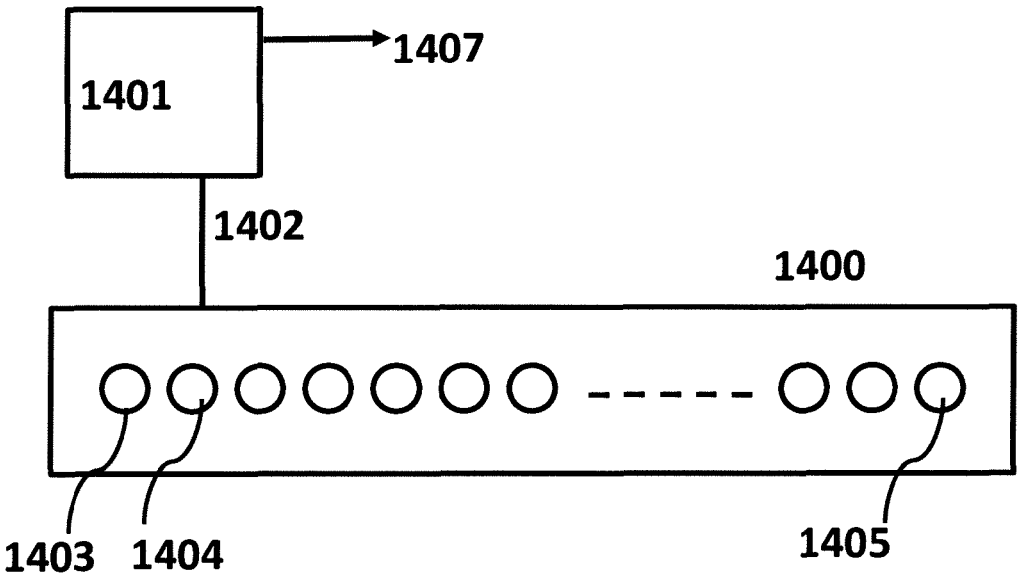
FIGS. 14-16 illustrate a microphone array in accordance with various aspects of the present invention.

FIG. 14 illustrates a linear array of microphones. A linear array is intended to mean herein a series of microphones aligned along a single line. FIG. 14 illustrates a linear array of N microphones, including first and second microphone 1403 and 1404, respectively and an Nth microphone 1405. The microphone may be held in a single line in a housing 1400. A circuit 1401 receives the N microphone signals through a connection 1402 and samples the required microphone signals with the required sampling frequency. The samples are outputted on an output 1407 for further processing.

In an embodiment of the present invention, the linear array has at least 100 microphones. In other embodiments of the present invention, the linear array has at least 200 microphones, or at least 300 microphones or at least 500 microphones. In yet another embodiment of the present invention, the linear array has at least 1000 microphones.

The microphones in the linear array are in one embodiment of the present invention at least 1 cm apart. The microphones in the linear array are in one embodiment of the present invention at least 5 cm apart. The microphones in the linear array are in one embodiment of the present invention at least 10 cm apart.

Figure 15:
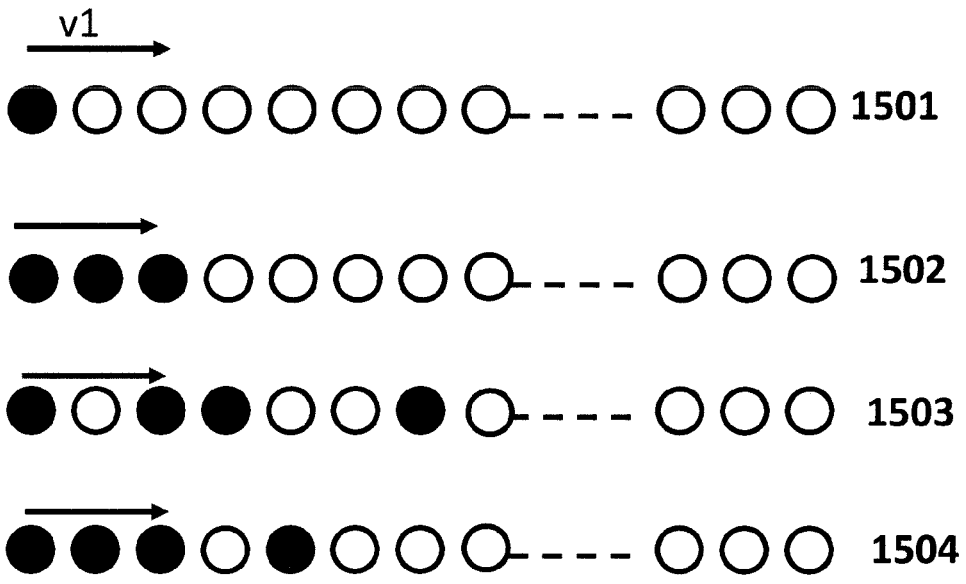

In one embodiment of the present invention the microphone signals generated by the linear array are sampled in such a way that a number of microphones appear to be moved with a virtual speed of v1 m/sec. This is illustrated in FIG. 15 in array 1501. The dots represent the microphones and a dark dot represents a microphone from which a sample is generated at a sampling frequency corresponding with a virtual speed v1.

One can also use for instance 3 directly adjacent microphones to be sampled as illustrated in FIG. 15 1502. One can also use for instance 4 microphones which are not all directly adjacent to be sampled as illustrated in FIG. 15 1503. One can also use for instance 4 microphones in a different configuration to be sampled as illustrated in FIG. 15 1504. In accordance with an aspect of the present invention one can thus select 1 or more microphones and sample the selected microphones' signals with a preferred sampling frequency.

In one embodiment of the present invention one moves at least one microphone at least twice through the linear array, the first run with a first virtual speed and the second run with a second virtual speed, determined for instance by the desired separation of a frequency component in a source signal. One may start re-sampling the microphones in the linear array starting from the first microphone before the last microphone has been sampled. In case different (virtual) microphone speeds are used one has to select the order so that no interference occurs.

A virtual speed of a microphone corresponds with or is related to a sampling frequency, though a sampling frequency does not necessarily have to be equivalent to the virtual speed. One could sample a set of microphones for a while and then move on to the next set of microphones.

Figure 16:
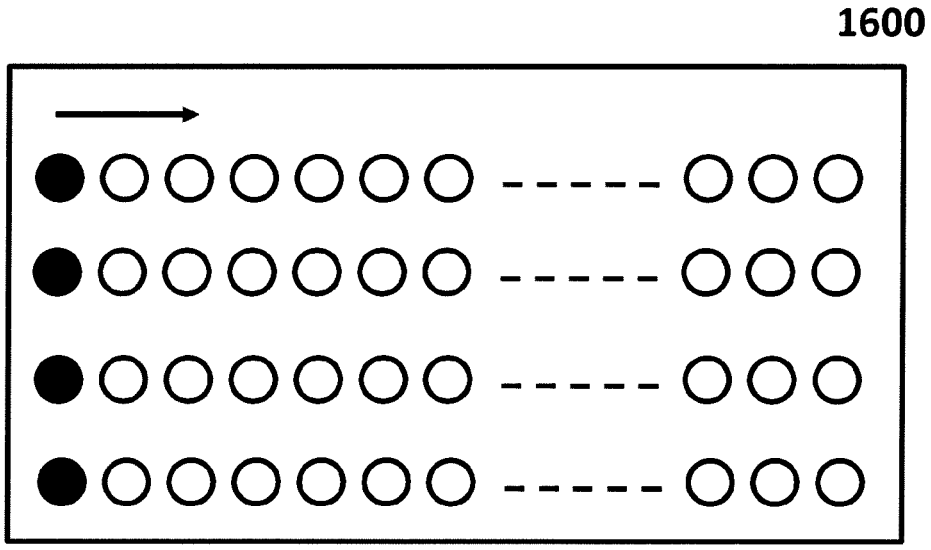

In one embodiment of the present invention one may use multiple linear microphone arrays as illustrated in FIG. 16.

The microphones in the linear array in one embodiment of the present invention are uniformly distributed in the linear array. The microphones in the linear array in one embodiment of the present invention are non-uniformly distributed in the linear array.

Highly correlated herein, is intended to mean in one embodiment of the present invention a correlation of greater than 0.6 on a scale of 0.0 to 1.0. Highly correlated herein, is intended to mean in one embodiment of the present invention a correlation of greater than 0.7 on a scale of 0.0 to 1.0. Highly correlated herein, is intended to mean in one embodiment of the present invention a correlation of greater than 0.8 on a scale of 0.0 to 1.0. Highly correlated herein, is intended to mean in one embodiment of the present invention a correlation of greater than 0.9 on a scale of 0.0 to 1.0.

A near-field source related to the linear array herein is intended to mean in accordance with an aspect of the present invention to occur when a distance between a source and the linear array of less than 10 times the wavelength of a relevant frequency component in a source signal. A near-field source related to the linear array herein is intended to mean in accordance with an aspect of the present invention to occur when a distance between a source and the linear array of less than 5 times the wavelength of a relevant frequency component in a source signal. A near-field source related to the linear array herein is intended to mean in accordance with an aspect of the present invention to occur when a distance between a source and the linear array of less than 2 times the wavelength of a relevant frequency component in a source signal.

A far field source related to the linear array herein is intended to mean in accordance with an aspect of the present invention to occur when a distance between a source and the linear array greater than 10 times the wavelength of a relevant frequency component in a source signal. A far field source related to the linear array herein is intended to mean in accordance with an aspect of the present invention to occur when a distance between a source and the linear array greater than 5 times the wavelength of a relevant frequency component in a source signal. A far field source related to the linear array herein is intended to mean in accordance with an aspect of the present invention to occur when a distance between a source and the linear array greater than 2 times the wavelength of a relevant frequency component in a source signal.

Figure 17:
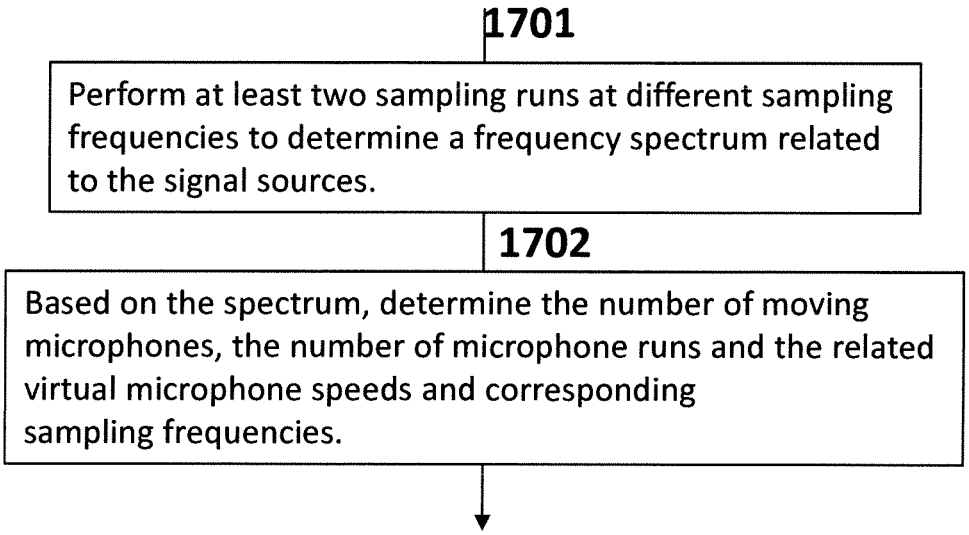
FIGS. 17-18 illustrate steps performed in accordance with various aspects of the present invention.

A virtual speed of a microphone provides different shifts in signals for different frequencies. In accordance with an aspect of the present invention, one samples the sources with two runs of at least one virtually moving microphone to determine frequency components or a frequency spectrum of the sources. Based on the detected shifts due to the virtual speed of the microphone one can determine in which frequency bands sufficient energy is present to warrant a further analysis. Based on the frequency of the signal component and a desired minimum shift a processor can determine the desired virtual speed and the corresponding sampling frequency. This is illustrated in FIG. 17, wherein in step 1701 the at least two sampling runs for determining a spectrum are performed and in step 1702 the number of relevant runs, to be sampled microphones and sampling frequencies are determined.

Figure 18:
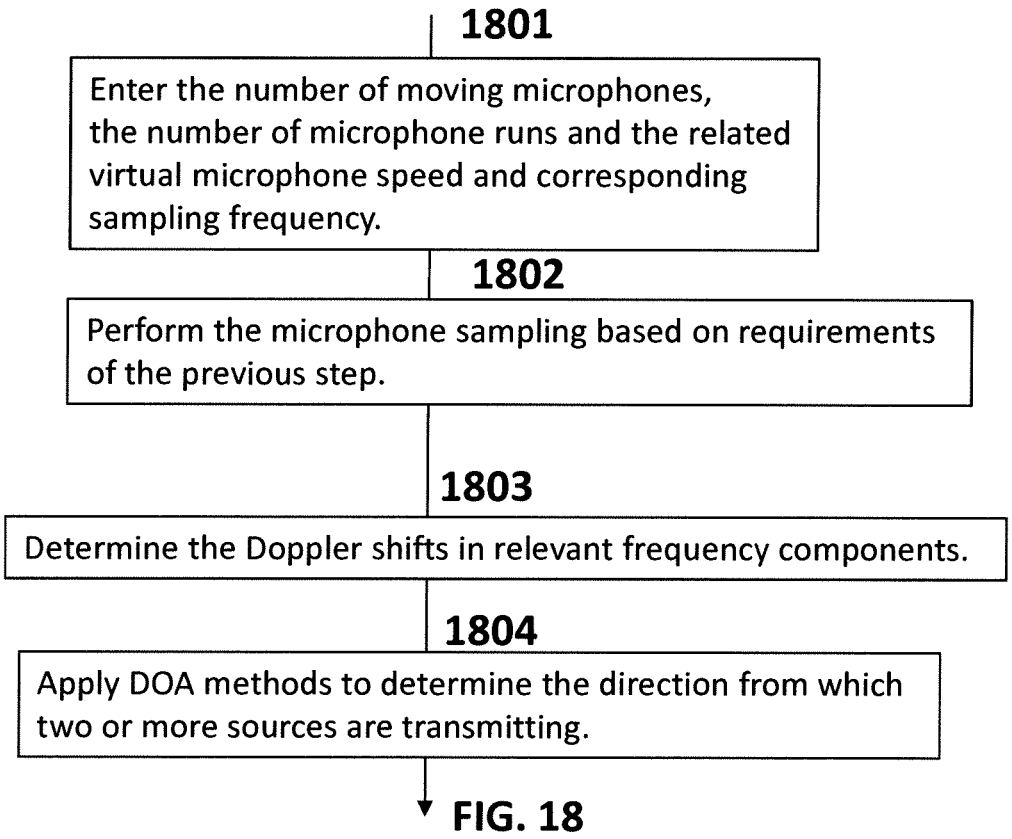

FIG. 18 illustrates the steps to perform the actual runs. In step 1801 the relevant parameters are provided, for instance to a circuit, which may be a processor, such as illustrated in FIG. 14 as 1401. Step 1801 may get its results from step 1702 in FIG. 17. In step 1802 the microphone samplings based on the parameters of step 1801 are performed. In step 1803 the relevant Doppler shifts are determined and in step 1804 Direction of Arrival (DOA) from the individual sources are determined. In step 1804 one or more known DOA methods, for instance Duet, MUST, MUSIC and/or ESPRIT are applied to determine the relevant directions of arrival. If sources are near-field, an actual location of the near-field sources will be determined. The MUST DOA method is explained in a 5 page appendix included herein.

Figure 19:
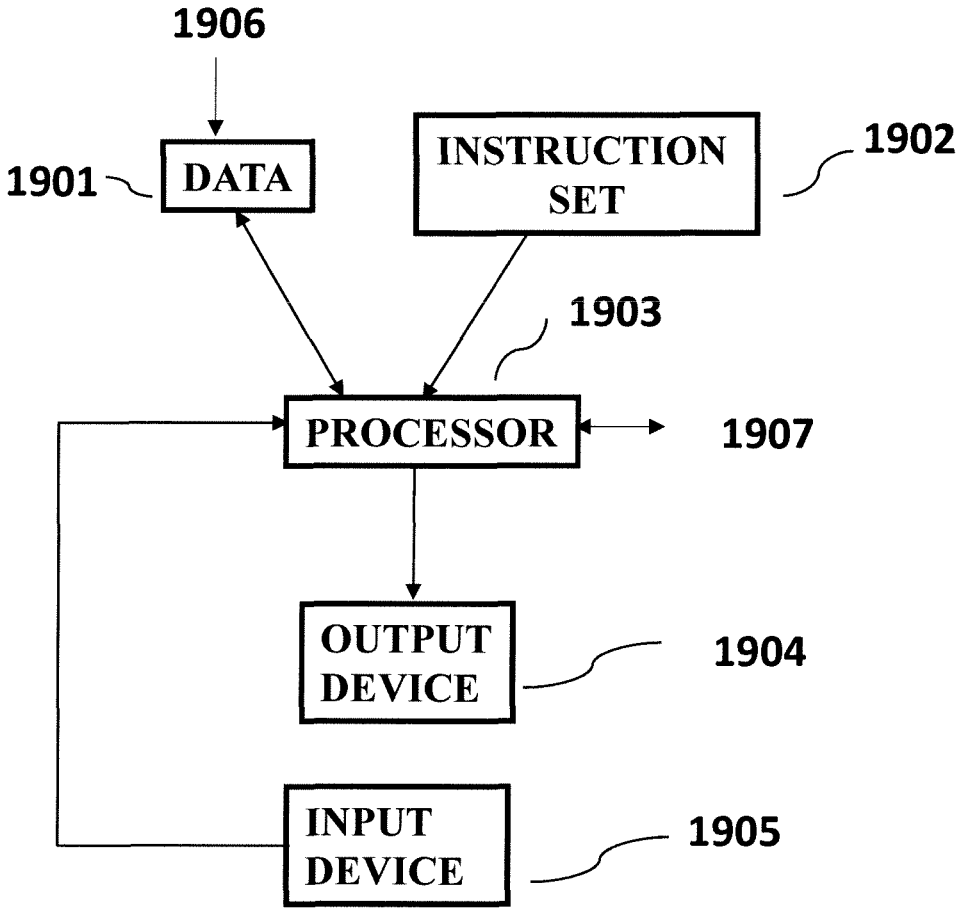
FIG. 19 illustrates a system enabled to perform steps of methods provided in accordance with various aspects of the present invention.

The methods as provided herein are, in one embodiment of the present invention, implemented on a system or a computer device. Thus, steps described herein are implemented on a processor, as shown in FIG. 19. A system illustrated in FIG. 19 and as provided herein is enabled for receiving, processing and generating data. The system is provided with data that can be stored on a memory 1901. Data may be obtained from a sensor such as a microphone or an array of microphones. Data may be provided on an input 1806. Such data may be acoustical data or any other data that is helpful in a source separation system. The processor is also provided or programmed with an instruction set or program executing the methods of the present invention that is stored on a memory 1902 and is provided to the processor 1903, which executes the instructions of 1902 to process the data from 1901. Data, such as acoustical data or any other data provided by the processor can be outputted on an output device 1904, which may be a loudspeaker to display sounds or a display to display images or data related a signal source or a data storage device. The processor also has a communication channel 1907 to receive external data from a communication device and to transmit data to an external device. The system in one embodiment of the present invention has an input device 1905, which may include a keyboard, a mouse, a pointing device, one or more microphones or any other device that can generate data to be provided to processor 1903.

The processor can be dedicated or application specific hardware or circuitry. However, the processor can also be a general CPU or any other computing device that can execute the instructions of 1902. Accordingly, the system as illustrated in FIG. 19 provides a system for processing data resulting from a sensor, a microphone, a microphone array or any other data source and is enabled to execute the steps of the methods as provided herein as one or more aspects of the present invention.

In accordance with one or more aspects of the present invention methods and systems to separate and/or detect concurrent signal sources such as acoustic sources with a microphone array have been provided. A microphone array in one embodiment of the present invention is a linear array of microphones. The microphones in the array are sampled asynchronously which is intended to mean at different times. The methods and/or the systems are identified herein under the acronym DREAM.

In one embodiment of the present invention aspects of the DREAM method as provided herein are applied to microphone arrays or sub-arrays that are not containing equidistant microphones nor microphone distances of a multiple of a standard microphone distance (e.g., 5 cm or its multiples). It is quite common to use e.g., Logarithmic microphone spacing in linear arrays to prevent that certain frequencies are not well recorded from some array positions (a standing wave could have minima at the locations of all microphones if their distance is a multiple of e.g., 5 cm). In one embodiment of the present invention a long array of equidistant microphones is provided from which one can flexibly pick microphones to build any microphone array at a desired position. In one embodiment of the present invention a microphone array is provided with fixed array positions with logarithmic arrays. This has advantages in some applications. In accordance with at least one aspect of the present invention 2D and 3D arrangements of moving microphones are provided. As stated above, one has to address airflow effects created by the moving microphones. In accordance with an aspect of the present invention the moving microphones move in patterns such as in a circle, spiral etc.

Applications

The methods and systems as provided herein can be applied to a wide range of different applications that involve the processing of signals from multiple sources. Several applications of the DREAM methods and systems are contemplated and provided as illustrative and non-limited examples.

In one embodiment of the present invention multiple concurrent signals are sent with full bandwidth from different locations to a DREAM based system. Rather than using beam forming, the DREAM can shift the frequency components to different bands and enable recovery of the signals. Also, this enables a secure transmission that requires a specific antenna array arrangement and sampling to enable signal recovery.

In one embodiment of the present invention a number and location of concurrent speakers in a conference setting can be detected robustly and at low costs by a DREAM system. Also, separation of speech signals from different people and reduction of background noise are improved with the DREAM concept.

In one embodiment of the present invention a DREAM system is applied in an improved acoustic Camera for detection and estimation of noise sources. Also, DREAM can be applied in acoustic machine health monitoring in noisy industrial environments.

Medical Industry: The DREAM could be used to improve acoustic separation of background signals from the heartbeat from a fetus or other localized sound sources.

In one embodiment of the present invention asynchronous sampling as disclosed herein as an aspect of the present invention and employed in a DREAM system is applied to separately analyze interfering reflections in geophysical data.

The following references provide background information generally related to the present invention and are hereby incorporated by reference: [1] J S. Rickard, R. Balan, and J. Rosca. Real-Time Time-Frequency Based Blind Source Separation. In Proc. of International Conference on Independent Component Analysis and Signal Separation (ICA2001), pages 651-656, 2001; [2] T. Wiese, H. Claussen, J. Rosca. Particle Filter Based DOA for Multiple Source Tracking (MUST). To be published in Proc. of ASILOMAR, 2011; [3] H. F. Silverman, W. R. Patterson, and J. L. Flanagan. The huge microphone array. Technical report, LEMS, Brown University, May 199; [4] E. Weinstein, K. Steele, A. Agarwal, and J. Glass, LOUD: A 1020-Node Microphone Array and Acoustic Beamformer. International Congress on Sound and Vibration (ICSV), July 2007, Cairns, Australia; [5] URLhttp://www.acoustic-camera.com/en/acoustic-camera-en; [6] www.fas.org/man/dod-101/nay/docs/es310/cwradar.htm; [7] R. Roy and T. Kailath. Esprit-estimation of signal parameters via rotational invariance techniques. Acoustics, Speech and Signal Processing, IEEE Transactions on, 37(7):984, July 1989; [8] R. Schmidt. Multiple Emitter Location and Signal Parameter Estimation. Antennas and Propagation, IEEE Transactions on, 34(3):276, March 1986; [9] D. N. Swingler and J. Krolik. Source Location Bias in the Coherently Focused High-Resolution Broad-Band Beamformer. Acoustics, Speech and Signal Processing, IEEE Transactions on, 37(1): 143-145, January 1989; [10] T. Melia and S. Rickard. Underdetermined Blind Source Separation in Echoic Environments Using DESPRIT. EURASIP Journal on Advances in Signal Processing, 2007; [11] J. A. Cadzow. Multiple Source Localization—The Signal Subspace Approach. IEEE Transactions on Acoustics, Speech, and Signal Processing, 38(7): 1110-1125, July 1990; [12] D. Peavey and T. Ogunfunmi. The Single Channel Interferometer Using A Pseudo-Doppler Direction Finding System. IEEE Transactions on Acoustics. Speech, and Signal Processing, 45(5):4129-4132, 1997; [13] R. Whitlock. High Gain Pseudo-Doppler Antenna. Loughborough Antennas & Propagation Conference. 2010; and [14] D. C. Cunningham, "Radio Direction Finding System", U.S. Pat. No. 4,551,727, Nov. 5, 1985.

The following provides an explanation of the MUST Direction-of-Arrival (DOA) method.

Direction of arrival estimation is a well researched topic and represents an important building block for higher level interpretation of data. The Bayesian algorithm proposed in this paper (MUST) can estimate and track the direction of multiple, possibly correlated, wideband sources. MUST approximates the posterior probability density function of the source directions in time-frequency domain with a particle filter. In contrast to other previous algorithms, no time-averaging is necessary, therefore moving sources can be tracked. MUST uses a new low complexity weighting and regularization scheme to fuse information from different frequencies and to overcome the problem of overfitting when few sensors are available.

Decades of research have given rise to many algorithms that solve the direction of arrival (DOA) estimation problem and these algorithms find application in fields like radar, wireless communications or speech recognition as described in "H. Krim and M. Viberg. Two Decades of Array Signal Processing Research: The Parametric Approach. Signal Processing Magazine, IEEE, 13(4):67-94, July 1996."

DOA estimation requires a sensor array and exploits time differences of arrival between sensors. Narrowband algorithms approximate these differences with phase shifts. Most of the existing algorithms for this problem are variants of ESPRIT described in "R. Roy and T. Kailath. Esprit-estimation of signal parameters via rotational invariance techniques. Acoustics, Speech and Signal Processing, IEEE Transactions on, 37(7):984, July 1989" or MUSIC described in "R. Schmidt. Multiple Emitter Location and Signal Parameter Estimation. Antennas and Propagation, IEEE Transactions on, 34(3):276, March 1986" that use subspace fitting techniques as described in "M. Viberg and B. Ottersten. Sensor Array Processing Based on Subspace Fitting. Signal Processing, IEEE Transactions on, 39(5):1110-1121, May 1991" and are fast to compute a solution.

In general, the performance of subspace based algorithms degrades with signal correlation. Statistically optimal methods such as Maximum Likelihood (ML) as described in "P. Stoica and K. C. Sharman. Maximum Likelihood Methods for Direction-of-Arrival Estimation. Acoustics, Speech and Signal Processing, IEEE Transactions on, 38(7):1132, July 1990" or Bayesian methods as described in "J. Lasenby and W. J. Fitzgerald. A Bayesian approach to high-resolution beamforming. Radar and Signal Processing, IEE Proceedings F, 138(6):539-544, December 1991." were long considered intractable as described in "J. A. Cadzow. Multiple Source Localization—The Signal Subspace Approach. IEEE Transactions on Acoustics, Speech, and Signal Processing, 38(7): 1110-1125, July 1990", but have been receiving more attention recently in "C. Andrieu and A. Doucet. Joint Bayesian Model Selection and Estimation of Noisy Sinusoids via Reversible Jump MCMC. Signal Processing, IEEE Transactions on, 47(10):2667-2676, October 1999" and "J. Huang, P. Xu, Y. Lu, and Y. Sun. A Novel Bayesian High-Resolution Direction-of-Arrival Estimator. OCEANS, 2001. MTS/IEEE Conference and Exhibition, 3:1697-1702, 2001."

Algorithms for wideband DOA are mostly formulated in the time-frequency (t-f) domain. The narrowband assumption is then valid for each subband or frequency bin. Incoherent signal subspace methods (ISSM) compute DOA estimates that fulfill the signal and noise subspace orthogonality condition in all subbands simultaneously. On the other hand, coherent signal subspace methods (CSSM) as described in "H. Wang and M. Kaveh. Coherent Signal-Subspace Processing for the Detection and Estimation of Angles of Arrival of Multiple Wide-Band Sources. Acoustics, Speech and Signal Processing, IEEE Transactions on, 33(4):823. August 1985" compute a universal spatial covariance matrix (SCM) from all data. Any narrowband signal subspace method can then be used to analyze the universal SCM. However, good initial estimates are necessary to correctly cohere the subband SCMs into the universal SCM as described in "D. N. Swingler and J. Krolik. Source Location Bias in the Coherently Focused High-Resolution Broad-Band Beamfoimer. Acoustics, Speech and Signal Processing, IEEE Transactions on, 37(1):143-145, January 1989." Methods like BI-CSSM as described in "T.-S. Lee. Efficient Wideband Source Localization Using Beamforming Invariance Technique. Signal Processing, IEEE Transactions on, 42(6):1376-1387, June 1994" or TOPS as described in "Y.-S. Yoon, L. M. Kaplan, and J. H. McClellan. TOPS: New DOA Estimator for Wideband Signals. Signal Processing, IEEE Transactions on, 54(6):1977, June 2006" were developed to alleviate this problem.

Subspace methods use orthogonality of signal and noise subspaces as criteria of optimality. Yet, a mathematically more appealing approach is to ground the estimation on a decision theoretic framework. A prerequisite is the computation of the posterior probability density function (pdf) of the DOAs, which can be achieved with particle filters. Such an approach is taken in "W. Ng, J. P. Reilly, and T. Kirubarajan. A Bayesian Approach to Tracking Wideband Targets Using Sensor Arrays and Particle Filters. Statistical Signal Processing, 2003 IEEE Workshop on, pages 510-513, 2003," where a Bayesian maximum a posteriori (MAP) estimator is formulated in the time domain.

A Bayesian MAP estimator is presented using the time-frequency representation of the signals. The advantage of time-frequency analysis is shown by techniques used in Blind Source Separation (BSS) such as DUET as described in "S. Rickard, R. Balan, and J. Rosca. Real-Time Time-Frequency Based Blind Source Separation. In Proc. of International Conference on Independent Component Analysis and Signal Separation (ICA2001), pages 651-656, 2001" and DESPRIT as described in "T. Melia and S. Rickard. Underdetermined Blind Source Separation in Echoic Environments Using DESPRIT. EURASIP Journal on Advances in Signal Processing, 2007:Article ID 86484, 19 pages, doi:10.1155/2007/86484, 2007." These algorithms exploit dissimilar signal fingerprints to separate signals and work well for speech signals.

The presented multiple source tracking (MUST) algorithm uses a novel heuristic weighting scheme to combine information across frequencies. A particle filter approximates the posterior density of the DOAs and a MAP estimate is extracted. Also some widely used algorithms are presented in the context of the present invention. A detailed description of MUST is also provided herein. Simulation results of MUST are presented and compared to the WAVES method as described in "E. D. di Claudio and R. Parisi. WAVES: Weighted Average of Signal Subspaces for Robust Wideband Direction Finding. Signal Processing, IEEE Transactions on, 49(10):2179, October 2001", CSSM, and IMUSIC.

Problem Formulation and Related Work

A linear array of M sensors is considered with distances between sensor 1 and m denoted as $d_m$. Impinging on this array are J unknown wavefronts from different directions $\theta_j$. The propagation speed of the wavefronts is c. The number J of sources is assumed to be known and J≤M. Echoic environments are accounted for through additional sources for echoic paths. The microphones are assumed to be in the farfield of the sources. In DFT domain, the received signal at the mth sensor in the nth subband can be modeled $$X_m(\omega_n) = \sum_{j=1}^{J} S_j(\omega_n) e^{-i\omega_n v_m \sin(\theta_j)} + N_m(\omega_n) \tag{75}$$

where $S_j(\omega_n)$ is the jth source signal, $N_m(\omega_n)$ is noise and $v_m = d_m/c$. The noise is assumed to be circularly symmetric complex Gaussian (CSCG) and independent and identically distributed (iid) within each frequency, that is, the $\sigma_n^2$ noise variances $\omega_n$. If one defines $$X_n = [X_1(\omega_n) \ldots X_M(\omega_n)]^T \tag{76}$$

$$N_n = [N_1(\omega_n) \ldots N_M(\omega_n)]^T \tag{77}$$

$$S_n = [S_1(\omega_n) \ldots S_J(\omega_n)]^T \tag{78}$$

$$\theta = [\theta_1, \ldots, \theta_J]^T \tag{79}$$

(75) can be rewritten in matrix vector notation as $$X_n = A_n(\theta) S_n + N_n \tag{80}$$

with the M×J steering matrix $$A_n(\theta) = [a(\omega_n, \theta_1) \ldots a(\omega_n, \theta_J)] \tag{81}$$

whose columns are the M×1 array manifolds $$a(\omega_n, \theta_j) = [1 e^{-i\omega_n v_2 \sin(\theta_j)} \ldots e^{-i\omega_n v_M \sin(\theta_j)}]^T \tag{82}$$

Subspace Methods

The most commonly used algorithms to solve the DOA problem compute signal and noise subspaces from the sample covariance matrix of the received data and choose those $\theta_j$ whose corresponding array manifolds $a(\theta_j)$ are closest to the signal subspace, i.e., that locally solve $$\hat{\theta}_j = \underset{\theta}{\operatorname{argmin}} a(\theta)^H E_N E_N^H a(\theta) \tag{83}$$

where the columns of $E_N$ form an orthonormal basis of the noise subspace. Incoherent methods compute signal and noise subspaces $E_N(\omega_n)$ for each subband and the $\theta_j$ are chosen to satisfy (83) on average. Coherent methods compute the reference signal and noise subspaces by transforming all data to a reference frequency $\omega_0$. The orthogonality condition (83) is then verified for the reference array manifold $a(\omega_0, \theta)$only. These methods, of which CSSM and WAVES are two representatives, show significantly better performance than incoherent methods, especially for highly correlated and low SNR signals. But the transformation to a reference frequency requires good initial DOA estimates and it is not obvious how these are obtained.

Maximum Likelihood Methods

In contrast to subspace algorithms. ML methods compute the signal subspace from the $A_n$ matrix and choose $\hat{\theta}$ that best fits the observed data in terms of maximizing its projection on that subspace, which can be shown to be equivalent to maximizing the likelihood:

$$\hat{\theta} = \underset{\theta}{\operatorname{argmax}} \|P_n(\theta)X_n\| \tag{84}$$

where $P_n = A_n(A_n^H A_n)^{-1} A_n^H$ is a projection matrix on the signal subspace spanned by the columns of $A_n(\theta)$ wherein these deterministic ML estimator presumes no knowledge of the signals. If signal statistics were known, stochastic ML estimates could be computed as described in "P. Stoica and A. Nehorai. On the Concentrated Stochastic Likelihood Function in Array Signal Processing. Circuits, Systems, and Signal Processing, 14:669-674, 1995. 10.1007/BF01213963."

If noise variances are equal for all frequencies, an overall log-likelihood function for the wideband problem can be obtained by summing (84) across frequencies. The problem of varying noise variances has not been addressed to date.

"C. E. Chen, F. Lorenzelli, R. E. Hudson, and K. Yao. Maximum Likelihood DOA Estimation of Multiple Wideband Sources in the Presence of Nonuniform Sensor Noise. EURASIP Journal on Advances in Signal Processing, 2008: Article ID 835079, 12 pages, 2008. doi:10.1155/2008/835079, 2008" investigates the case of non-uniform noise with respect to sensors, but constant across frequencies.

ML methods offer higher flexibility regarding array layouts and signal correlations than subspace methods and generally show better performance for small sample sizes, but the nonlinear multidimensional optimization in (84) is computationally complex. Recently, importance sampling methods have been proposed for the narrowband case to solve the optimization problem efficiently as described in "H. Wang, S. Kay, and S. Saha. An Importance Sampling Maximum Likelihood Direction of Arrival Estimator. Signal Processing, IEEE Transactions on, 56(10):5082-5092, 2008." The particle filter employed in MUST tackles the optimization along these lines.

Multiple Source Tracking (Must)

Under the model of equation (75), the observations $X_1(\omega_n), \ldots, X_M(\omega_n)$ are iid CSCG random variables if conditioned on $S_n$ and $\theta$. Therefore, the joint pdf factorizes into the marginals. Hence, for each frequency $\omega_n$, the negative log-likelihood is given by $$-\log p(X_n|S_n,\theta) \propto \|X_n - A_n(\theta)S_n\|^2 \tag{85}$$

It is common to compute the ML solution for $S_n$ as $$\hat{S}_n(\theta) = A_n^{\dagger}(\theta)X_n \tag{86}$$

with $A_n^{\dagger}$ denoting the Moore-Penrose inverse of $A_n$. An ML solution for $\theta$ can then be found by minimizing the remaining concentrated negative log-likelihood $$L_n(\theta) := \|X_n - A_n(\theta)A_n^{\dagger}(\theta)X_n\|^2 \tag{87}$$

If the noise variances $\sigma_n^2$ were known, a global (negative) concentrated log-likelihood could be computed by summing the likelihoods for all frequencies:

$$L(\theta) = \sum_{n=1}^{N} \frac{L_n(\theta)}{\sigma_n^2} \tag{88}$$

This criterion function has been stated previously and was considered intractable (in 1990) in "J. A. Cadzow. Multiple Source Localization—The Signal Subspace Approach. IEEE Transactions on Acoustics, Speech, and Signal Processing, 38(7):1110-1125, July 1990." In contrast to subspace methods, ML methods and MUST, which uses ML estimates of the source signals, are insensitive to correlated sources, because they do not attempt to estimate rank J signal subspaces.

Further below, a particle filter method is provided in accordance with an aspect of the present invention to solve the filtering problem for multiple snapshots that naturally solves the optimization problem as a byproduct. It was found that in practical applications, a regularization scheme can improve performance, as will be shown below. Furthermore, weighting of the frequency bins is necessary. The low-complexity approach provided herein in accordance with an aspect of the present invention is explained below.

Regularization

Equation (86) is a simple least squares regression and great care must be taken with the problem of overfitting the data. This problem is accentuated if the number of microphones is small or if the assumption of J signals breaks down in some frequency bins.

In ridge-regression, penalty terms are introduced for the estimation variables and in Bayesian analysis these translate to prior distributions for the $S_n$. In order to reduce complexity, CSCG priors are used with a single global regularization parameter $\lambda$ for all frequencies and sources:

$$-\log p(S_n) \propto \sum_{j=1}^{J} \lambda |S_j(\omega_n)|^2 \tag{89}$$

Similarly to (86), a MAP estimate of $S_n$ is $$\hat{S}_n(\theta) = (A_n^H A_n + \lambda I)^{-1} A_n^H X_n \tag{90}$$

One can now eliminate $S_n$ and work exclusively with the concentrated log-likelihoods that can be written $$L_n^{reg}(\theta) := \|I - \hat{P}_n(\theta)X_n\|^2 \tag{91}$$

with $$\hat{P}_n(\theta) = A_n(A_n^H A_n + \lambda I)^{-1} A_n^H \tag{92}$$

The $\lambda$ parameter is chosen ad hoc. It was found that values of $10^{-5}$M if many microphones are available with respect to sources up to $10^{-3}$M if few microphones are available improve the estimation. If information about $S_n$ was available, more sophisticated regularization models could be envisaged.

Weighting

The noise variance $\sigma_n^2$ in (88) cannot be estimated from a single snapshot. Instead, the noise variances are re-interpreted as weighting factors $\tau_n := \sigma_n^{-2}$, a viewpoint that is taken by BSS algorithms like DUET. In practice, the signal bandwidths may not be known exactly and in some frequency bins the assumption of J signals breaks down. The problem of overfitting becomes severe in these bins and including them in the estimation procedure can distort results. The following weights are provided in accordance with an aspect of the present invention to account for inaccurate modeling, high-noise bins, and outlier bins:

$$\hat{\tau}_n = \varphi\left(\frac{\|\hat{P}_n(\theta)X_n\|}{X_n}\right) \tag{93}$$

-continued $$\tau_n = \frac{\hat{\tau}_n}{\sum_{n=1}^{N} \hat{\tau}_n} \tag{94}$$

where $\phi$ is a non-negative non-decreasing weighting function. Its argument measures the portion of the received signal that can be explained given the DOA vector $\theta$. $\tau_n$ are the normalized weights.

Particle Filter

Based on the weighting and regularization schemes, the concentrated likelihood function reads $$p(X_{1:N}|\theta) \propto e^{-\gamma L(\theta)} \tag{95}$$

where a scaling parameter is introduced that determines the sharpness of the peaks of the likelihood function. A heuristic is given for $\gamma$ below. However, this is the true likelihood function only if the true noise variance at frequency n is $\theta_n^2=(\gamma\tau_n)^{-1}$. In what follows it is assumed that this to be the case. Now, the time dimension will be included into the estimation procedure.

First, a Markov transition kernel is defined for the DOAs to relate information between snapshots k and k−1

$$p(\theta_j^k \mid \theta_j^{k-1}) = \alpha U_{[-\frac{\pi}{2},\frac{\pi}{2}]} + (1-\alpha) N(\theta_j^{k-1}, \sigma_\theta^2) \tag{96}$$

where $$U_{[-\frac{\pi}{2},\frac{\pi}{2}]}$$

denotes the pdf of a uniform distribution on $$[-\frac{\pi}{2}, \frac{\pi}{2}],$$

and $N(\theta_j^{k-1}, \tau_\theta^2)$ denotes the pdf of a normal distribution with mean $\theta_j^{k-1}$ and variance $\sigma_\theta^2$. A small world proposal density as described in "Y. Guan, R. Fleiβner. P. Joyce, and S. M. Krone. Markov Chain Monte Carlo in Small Worlds. Statistics and Computing, 16:193-202, June 2006." This is likely to speed up convergence, especially in the present case with multimodal likelihood functions. The authors of "Y. Guan, R. Fleiβner, P. Joyce, and S. M. Krone. Markov Chain Monte Carlo in Small Worlds. Statistics and Computing, 16:193-202, June 2006" give a precise rule for the selection of $\alpha$, which requires exact knowledge of the posterior pdf. However, they also argue that $\alpha\epsilon[10^{-4}, 10^{-1}]$ is a good rule of thumb.

Let $I^k$ denote all measurements (information) until snapshot k. Assume that for a particular realization of $I^{k-1}$ a discrete approximation of the old posterior pdf is available:

$$p(\theta^{k-1} \mid I^{k-1}) = \sum_{i=1}^{P} \omega_i^{k-1} \delta_{\theta_i^{k-1}} \tag{97}$$

where the $\delta_{\theta_i^{k-1}}$ are Dirac masses at $\theta_i^{k-1}$. The $\theta_i^{k-1}$ together with their associated weights $\omega_i^{k-1}$ called particles. These particles contain all available information up to snapshot k−1.

The index i of $\theta$ refers to one of the P particles and that $\theta_i=[\theta_1, \ldots, \theta_J]_i=[\theta_{i,1}, \ldots, \theta_{i,J}]$. New measurements $X_{1:N}^k$ are integrated iteratively through Bayes' rule $$p(\theta^k|I^k) \propto p(X_{1:N}^k|\theta^k) p(\theta^k|\theta^{k-1}) p(\theta^{k-1}|I^{k-1}) \tag{98}$$

An approximation of the new posterior can be obtained in two steps as described in "S. Arulampalam. S. Maskell, N. Gordon, and T. Clapp. A Tutorial on Particle Filters for On-line Non-linear/Non-Gaussian Bayesian Tracking. IEEE Transactions on Signal Processing, 50:174-188, 2001." First, each particle is resampled from the transition kernel $$\theta_i^k \sim p(\theta_i^k|\theta_i^{k-1}) \tag{99}$$

In a second step, the weights are updated with the likelihood and renormalized:

$$\hat{\omega}_i^k = \omega_i^{k-1} p(X_{1:N}^k \mid \theta_i^k) \tag{100}$$

$$\omega_i^k = \frac{\hat{\omega}_i^k}{\sum_{i=1}^{P} \hat{\omega}_i^k} \tag{101}$$

The $\gamma$parameter influences the reactivity of the particle filter. A small value puts small confidence into new measurements while a big value rapidly leads to particle depletion, i.e., all weight is accumulated by few particles. Through experimentation it was found that a good heuristic for $\gamma$ that reduces the necessity for resampling of the particles while maintaining the algorithm's speed of adaptation is $$\gamma = \frac{10}{\sum_{i=1}^{P} L(\theta_i)} \tag{102}$$

The problem of particle depletion is addressed by resampling if the effective number of particles $$N_{eff} = \left(\sum_{i=1}^{P} (\omega_i^k)^2\right)^{-1} \tag{103}$$

falls below a predetermined threshold. This particle filter is known as a Sampling Importance Resampling (SIR) filter as described in "S. Arulampalam, S. Maskell, N. Gordon, and T. Clapp. A Tutorial on Particle Filters for On-line Non-linear/Non-Gaussian Bayesian Tracking. IEEE Transactions on Signal Processing, 50:171-188, 2001."

A MAP estimate of $\theta$ can be obtained from the particles through use of histogram based methods. However, the particles are not spared from the permutation invariance problem as described in "H. Sawada, R. Mukai, S. Araki, and S. Makino. A Robust and Precise Method for Solving the Permutation Problem of Frequency-Domain Blind Source Separation. Speech and Audio Processing, IEEE Transactions on, 12(5):530-538, 2004." The likelihood function does not change its value if for some particle $\theta_{i,j'}$ and $\theta_{i,j''}$ are interchanged. To account for this problem, a simple clustering technique is used that associates $\theta_{i,j'}$ to the closest estimate of $\theta_j^{k-1}$ computed from all the particles at the previous time step. If several $\theta_{i,j'}$, $\theta_{i,j''}$ are assigned to the same source, this issue is resolved through re-assignment, if possible, or neglecting of one of $\theta_{i,j'}$ and $\theta_{i,j''}$ in the calculation of the MAP estimate.

Complexity

The main load of MUST is the computation of $(A_n^H A_n + \lambda I)^{-1} A_n^H X_n$ in (90), which has to be done for P particles and N frequency bins. Solving a system of J linear equations requires $O(J^3)$ operations and can be carried out efficiently using BLAS routines. Accordingly, the complexity of updating the MAP estimates of $\theta$ is $O(NPJ^3)$. Note that the number J of sources also determines the number P of particles necessary for a good approximation.

Computer Simulations

Three different computer simulated scenarios were executed for comparison. In all scenarios, equal power Gaussian noise sources with correlation $\rho \in [-1,1]$ were recorded by M sensors. Processing was performed on N frequency bins within the sensor passband $f_0 \pm \Delta f$. WAVES. CSSM, and IMUSIC compute DOA estimates based on the current and the Q preceding snapshots. This allowed for on-line dynamic computations. The particles were initialized with a uniform distribution. The weighting function used was $\phi(x)=x^4$.

In the first two scenarios, inter-sensor spacing was $$d = \frac{\lambda_0}{2}$$

between all elements where $$\lambda_0 = \frac{c}{f_0} ..$$

The parameter values are summarized in Table 3.

TABLE 3

| | M | Source Positions | $f_x$ | $f_0$ | $\Delta f$ | N | Q | P | $\sigma_\theta^2$ | $\alpha$ | $\lambda$ |
|---|---|---|---|---|---|---|---|---|---|---|---|
| Scenario 1 | 10 | 8, 13, 33 and 37 degrees | 400 Hz | 100 Hz | 40 Hz | 52 | 25 | 2000 | $(0.5°)^2$ | 0.03 | $10.10^{-4}$ |
| Scenario 2 | 7 | 8, 13 and 33 degrees | 44 kHz | 10 kHZ | 9.9 kHz | 462 | 88 | 300 | $(0.4°)^2$ | 0.03 | $3.10^{-4}$ |
| Scenario 3 | 5 | moving | 400 Hz | 100 Hz | 40 Hz | 52 | — | 1000 | $(3°)^2$ | 0.05 | $5.10^{-3}$ |

All results are based on 100 Monte Carlo runs for each combination of parameters.

WAVES and CSSM used RSS focusing matrices as described in "H. Hung and M. Kaveh. Focussing Matrices for Coherent Signal-Subspace Processing. Acoustics, Speech and Signal Processing, IEEE Transactions on, 36(8):1272-1281, August 1988" to cohere the sample SCMs with the true angles as focusing angles. This is an unrealistic assumption but provides an upper bound on performance for coherent methods. The WAVES algorithm is implemented as described in "E. D. di Claudio and R. Parisi. WAVES: Weighted Average of Signal Subspaces for Robust Wideband Direction Finding. Signal Processing, IEEE Transactions on, 49(10):2179, October 2001" and Root-MUSIC was used for both CSSM and WAVES.

Figure 20:
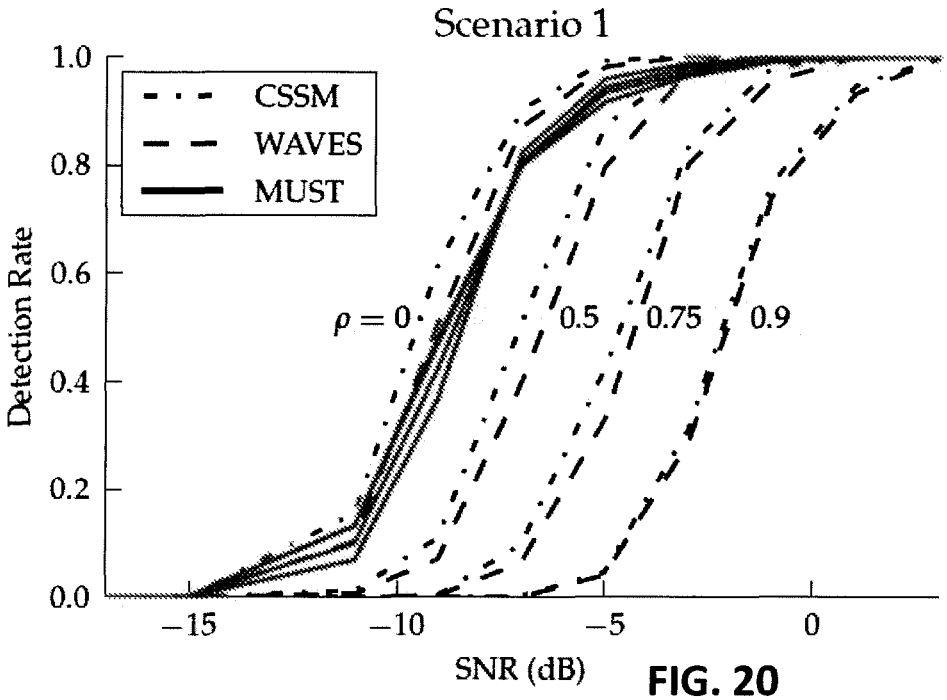
FIGS. 20-22 illustrate a performance of the MUST DOA method.

The first scenario was used and described in "H. Wang and M. Kaveh. Coherent Signal-Subspace Processing for the Detection and Estimation of Angles of Arrival of Multiple Wide-Band Sources. Acoustics, Speech and Signal Processing, IEEE Transactions on, 33(4):823, August 1985" and "E. D. di Claudio and R. Parisi. WAVES: Weighted Average of Signal Subspaces for Robust Wideband Direction Finding. Signal Processing, IEEE Transactions on, 49(10):2179. October 2001" to test wideband DOA and which is illustrated in FIG. 20. FIG. 20 illustrates a Percentage of blocks where all sources are detected within 2 degrees versus SNR for different values of the source correlation $\rho$. The $\rho$ labels refer to the WAVES and CSSM curves while all four MUST curves nearly collapse. The results show that the particle filter algorithm can resolve closely spaced signals at low SNR values and for arbitrary correlations. In contrast, the performance of CSSM decreases with correlation. IMUSIC did not succeed in resolving all four sources.

Figure 21:
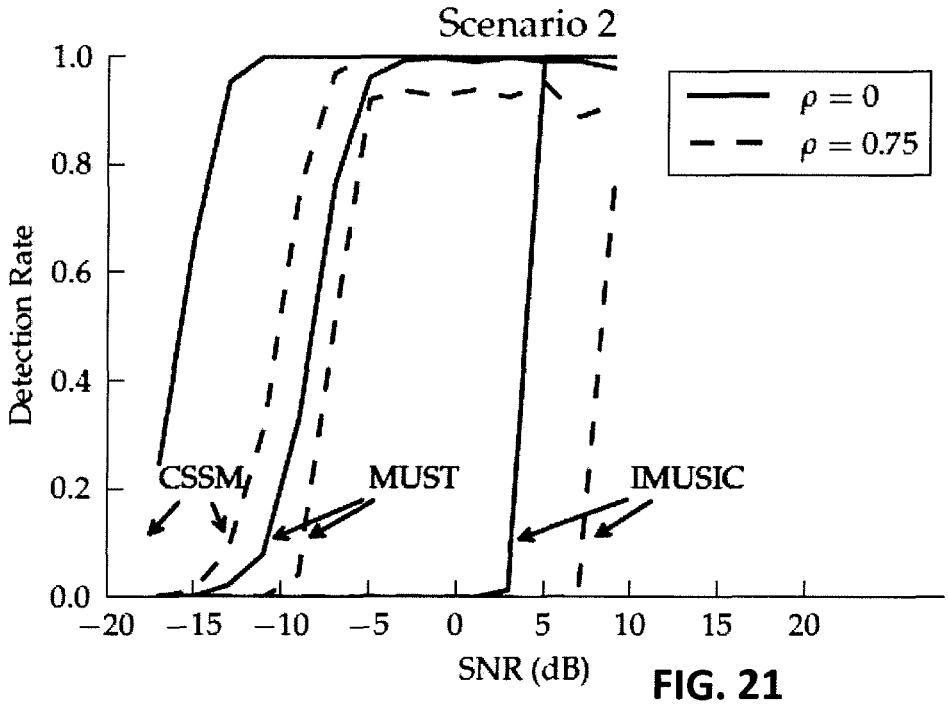

For the second scenario, parameters were used relevant for audio signals as illustrated in FIG. 21. Percentage of blocks where all sources are detected within 2.5 degrees versus SNR for $\rho=0$ (straight lines) and $\rho=0.75$ (dashed lines). The parameters were chosen to illustrate the performance of a stripped down version of the particle filter that uses only 10% of the frequency bins containing most energy and a relatively small number of particles. Under these settings, real-time computations on a dual-core laptop computer were achieved. The performance of MUST is between IMUSIC and CSSM. The WAVES results were nearly identical with the CSSM results and are not shown for legibility.

Figure 22:
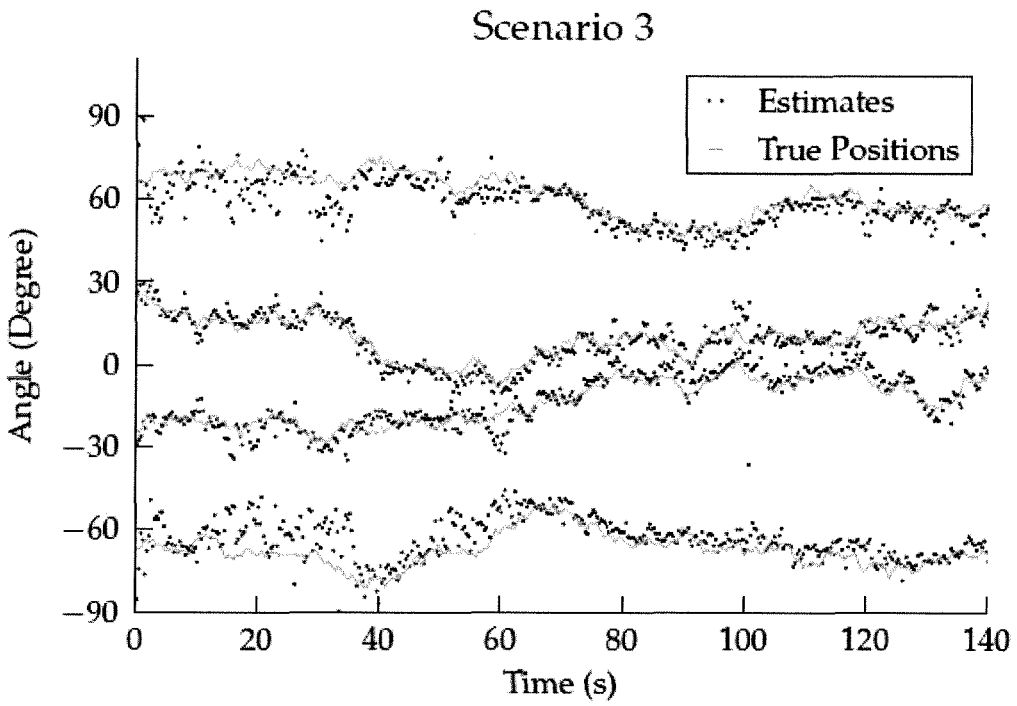

In the third scenario the potential of MUST to track moving sources is shown in FIG. 22. A non-uniform linear array of M=5 sensors was used with distances $$d_m = d_{m-1} = d + \Delta d \text{ where } d = \frac{\lambda_0}{c} \text{ and } \Delta d \sim U_{[-0.2d,0.2d]}.$$

The signals were concentrated in the signal passband $[f_0-\Delta f_{SRC}, f_0+\Delta f_{SRC}] \subset [f_0-\Delta f, f_0+\Delta f]$ with $\Delta f_{SRC}=20$ Hz and an SNR of 0 dB total signal power to total noise power. The MUST method succeeded in estimating the correct source locations of moving sources, while this scenario posed problems for the static subspace methods.

While there have been shown, described and pointed out fundamental novel features of the invention as applied to preferred embodiments thereof, it will be understood that various omissions and substitutions and changes in the form and details of the methods and systems illustrated and in its operation may be made by those skilled in the art without departing from the spirit of the invention. It is the intention, therefore, to be limited only as indicated by the scope of the claims.

The invention claimed is:

1. A method to separate a plurality of concurrently transmitting real acoustical sources, comprising:

receiving acoustical signals transmitted by the concurrently transmitting real acoustical sources by a linear microphone array with a plurality of non-rotating real microphones with the plurality of microphones being in a fixed position;

sampling by a processor at a first moment, signals generated by a first number of microphones in a first position in the linear microphone array at a first sampling frequency, the first number being smaller than a total number of microphones in the plurality of microphones;

sampling by the processor at a second moment following the first moment at the first sampling frequency, signals generated by a second number of microphones in a second position in the linear microphone array equal in number to the first number of microphones, wherein the first sampling frequency is based on a first virtual speed of the first number of microphones that is determined by a distance between the first and second position and a time difference between the first and second moment, wherein the first and second number of microphones are sampled asynchronously; and the processor determining a Doppler shift from the sampled signals to separate a direction of a first real acoustical source from a second real acoustical source in the plurality of concurrently transmitting real acoustical sources relative to the linear microphone array based on the first virtual speed of the first number of microphones.

2. The method of claim 1, wherein the linear microphone array has at least 100 microphones.

3. The method of claim 1, wherein the first number of microphones is one.

4. The method of claim 1, wherein the first number of microphones is at least two.

5. The method of claim 1, wherein the first virtual speed is at least 1 m/s.

6. The method of claim 1, further comprising the processor determining the plurality of acoustical sources.

7. The method of claim 1, wherein at least one source is a near field source.

8. The method of claim 1, wherein at least two sources generate signals that have a correlation that is greater than 0.8.

9. The method of claim 1, further comprising the first number of microphones in the linear microphone array is operated at a second virtual speed.

10. The method of claim 1, further comprising:

sampling a second number of microphones in the linear array of microphones at a second and a third virtual speed to determine the first virtual speed.

11. A system to separate a plurality of concurrently transmitting acoustical sources, comprising:

memory enabled to store data;

a processor enabled to execute instructions to perform the steps:

sampling at a first moment, signals generated by a first number of microphones in a first position in a linear microphone array with a plurality of non-rotating real microphones at a first sampling frequency, the first number being smaller than a total number of microphones in the linear microphone array;

sampling at a second moment following the first moment at the first sampling frequency, signals generated by a second number of real microphones in a second position in the linear microphone array, the second number equal in number to the first number of microphones, wherein the first sampling frequency is based on a first virtual speed of the first number of microphones that is determined by a distance between the first and second position and a time difference between the first and second moment; and determining a Doppler shift from the sampled signals based on the first virtual speed of the first number of microphones.

12. The system of claim 11, wherein a direction of a source in the plurality of concurrently transmitting acoustical sources relative to the linear microphone array is derived from the Doppler shift.

13. The system of claim 11, wherein the linear microphone array has at least 100 microphones.

14. The system of claim 11, wherein the first number of microphones is one.

15. The system of claim 11, wherein the first number of microphones is at least two.

16. The system of claim 11, wherein at least one source is a near field source.

17. The system of claim 11, wherein at least two sources generate signals that have a correlation that is greater than 0.8.

18. The system of claim 11, further comprising the first number of microphones in the linear microphone array being sampled at a sampling frequency corresponding with a second virtual speed.

19. The system of claim 11, further comprising:

the processor sampling a second number of microphones in the linear array of microphones at a second and a third virtual speed to determine the first virtual speed.

20. A method to separate a plurality of concurrently transmitting real acoustical sources, comprising:

receiving acoustical signals transmitted by the concurrently transmitting real acoustical sources by a linear microphone array with a plurality of non-rotating real microphones each in a fixed location;

sampling by a processor at a first moment, signals generated by a first number of real microphones, the first number being greater than 1 but smaller than a total number of real microphones in the linear microphone array, in a first fixed position in the linear microphone array at a first sampling frequency;

sampling by the processor at a second moment following the first moment at the first sampling frequency, signals generated by a second number of real microphones in a different second fixed position in the linear microphone array equal in number to the first number of real microphones, wherein the first sampling frequency is determined from a distance between the first and second position and a time difference between the first and second moment; and the processor determining a frequency shift from the sampled signals to determine a direction of a source in the plurality of concurrently transmitting real acoustical sources relative to the linear microphone array based on the distance between the first and second position and a time difference between the first and second moment.

* * * * *